US010688798B2

(12) United States Patent
Murata

(10) Patent No.: US 10,688,798 B2
(45) Date of Patent: Jun. 23, 2020

(54) LIQUID EJECTING APPARATUS

(71) Applicant: BROTHER KOGYO KABUSHIKI KAISHA, Nagoya-shi, Aichi-ken (JP)

(72) Inventor: Akikazu Murata, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/143,696

(22) Filed: Sep. 27, 2018

(65) Prior Publication Data

US 2019/0092037 A1 Mar. 28, 2019

(30) Foreign Application Priority Data

Sep. 28, 2017 (JP) ..... 2017-187632
Mar. 30, 2018 (JP) ..... 2018-067864

(51) Int. Cl.

| | |
|---|---|
| ***B41J 2/325*** | (2006.01) |
| ***B41J 2/175*** | (2006.01) |
| ***B41J 29/13*** | (2006.01) |
| ***B41J 2/165*** | (2006.01) |
| ***B41J 29/38*** | (2006.01) |

(52) U.S. Cl.

CPC ..... *B41J 2/17566* (2013.01); *B41J 2/16508* (2013.01); *B41J 2/16511* (2013.01); *B41J 2/16517* (2013.01); *B41J 2/16523* (2013.01); *B41J 2/16538* (2013.01); *B41J 2/17506* (2013.01); *B41J 2/17596* (2013.01); *B41J 29/13* (2013.01); *B41J 29/38* (2013.01)

(58) Field of Classification Search

CPC ..... B41J 3/51; B41J 2/325; B41J 2/33; B41J 3/60; B41J 13/12; G06K 13/08; G07F 19/201

See application file for complete search history.

(56) References Cited

U.S. PATENT DOCUMENTS

| | | | |
|---|---|---|---|
| 9,415,601 B1 | 8/2016 | Tsukida | |
| 2012/0044285 A1 | 2/2012 | Ogasawara et al. | |
| 2016/0214393 A1* | 7/2016 | Matsui | B41J 2/17566 |

FOREIGN PATENT DOCUMENTS

| | | |
|---|---|---|
| JP | 2002-052738 A | 2/2002 |
| JP | 2004-098360 A | 4/2004 |
| JP | 2007-083548 A | 4/2007 |
| JP | 2014-156124 A | 8/2014 |
| JP | 2016-041478 A | 3/2016 |
| JP | 2016-175377 A | 10/2016 |
| JP | 2016-185623 A | 10/2016 |

* cited by examiner

*Primary Examiner* — Lamson D Nguyen
(74) *Attorney, Agent, or Firm* — Scully, Scott, Murphy & Presser, PC

(57) ABSTRACT

A liquid ejecting apparatus, including: a liquid tank; an image recorder; a liquid bottle attachable to and removable from the liquid; a remaining-amount detecting sensor; a notifying device; a storage; and a controller configured to: determine a liquid remaining amount in the liquid bottle based on a detection signal from the remaining-amount detecting sensor, in a state in which the liquid bottle is attached to the liquid tank; store, in the storage, the determined liquid remaining amount in the liquid bottle; and control the notifying device based on the liquid remaining amount in the liquid bottle stored in the storage to notify a user of remaining-amount information relating to the liquid remaining amount in the liquid bottle.

17 Claims, 16 Drawing Sheets

LIQUID EJECTING APPARATUS

CROSS REFERENCE TO RELATED APPLICATION

The present application claims priority from Japanese Patent Application Nos. 2017-187632 and 2018-067864, which were respectively filed on Sep. 28, 2017 and Mar. 30, 2018, the disclosure of which is herein incorporated by reference in its entirety.

BACKGROUND

Technical Field

The following disclosure relates to a liquid ejecting apparatus including a liquid tank into which a liquid in a liquid bottle is pourable.

Description of Related Art

A known printing apparatus includes a pair of electrodes disposed in an ink tank. The printing apparatus is capable of detecting the presence or absence of ink in the ink tank by a resistance value between the pair of electrodes.

SUMMARY

Though the known printing apparatus is capable of detecting the presence or absence of the ink in the ink tank, the apparatus is not configured to detect a remaining amount of ink in an ink bottle from which the ink is poured into the ink tank. The printing apparatus not configured to detect the ink remaining amount in the ink bottle cannot notify a user of information relating to the ink remaining amount in the ink bottle.

Accordingly, the present disclosure relates to a liquid ejecting apparatus capable of notifying a user of information relating to a remaining amount of a liquid in a liquid bottle.

In one aspect of the disclosure, a liquid ejecting apparatus, includes: a liquid tank including a liquid storing chamber in which a liquid is stored and an inlet through which the liquid is poured into the liquid storing chamber; an image recorder configured to eject the liquid supplied from the liquid storing chamber, so as to record an image on a recording medium; a liquid bottle configured to be attachable to and removable from the liquid tank and storing the liquid therein, the liquid bottle being configured such that, in a state in which the liquid bottle is attached to the liquid tank, the liquid is poured into the liquid storing chamber through the inlet independently of a liquid supply from the liquid tank to the image recorder that arises from a liquid ejection from the image recorder, a remaining-amount detecting sensor configured to output a detection signal for determining a liquid remaining amount in the liquid bottle; a notifying device configured to notify a user of information; a storage configured to store the liquid remaining amount in the liquid bottle; and a controller configured to control the image recorder and the notifying device, wherein the controller is configured to: determine the liquid remaining amount in the liquid bottle based on the detection signal output from the remaining-amount detecting sensor, in the state in which the liquid bottle is attached to the liquid tank; store, in the storage, the determined liquid remaining amount in the liquid bottle; and control the notifying device based on the liquid remaining amount in the liquid bottle stored in the storage to notify the user of remaining-amount information relating to the liquid remaining amount in the liquid bottle, as the information.

In another aspect of the disclosure, a liquid ejecting apparatus includes: a liquid tank including a liquid storing chamber in which a liquid is stored and an inlet through which the liquid is poured into the liquid storing chamber; an image recorder configured to eject the liquid supplied from the liquid storing chamber, so as to record an image on a recording medium; a notifying device configured to notify a user of information; a storage; and a controller configured to control the image recorder and the notifying device, wherein the liquid tank is configured such that a liquid bottle storing the liquid therein is attachable to and removable from the liquid tank, the liquid bottle being configured such that, in a state in which the liquid bottle is attached to the liquid tank, the liquid is poured from the liquid bottle into the liquid storing chamber through the inlet independently of a liquid supply from the liquid tank to the image recorder that arises from a liquid ejection from the image recorder, wherein at least one of the liquid bottle and the liquid ejecting apparatus is provided with a remaining-amount detecting sensor configured to output a detection signal for detecting a liquid remaining amount in the liquid bottle, and wherein the controller is configured to: determine the liquid remaining amount in the liquid bottle based on the detection signal output from the remaining-amount detecting sensor, in the state in which the liquid bottle is attached to the liquid tank; store, in the storage, the determined liquid remaining amount in the liquid bottle; and control the notifying device based on the liquid remaining amount in the liquid bottle stored in the storage to notify the user of remaining-amount information relating to the liquid remaining amount in the liquid bottle, as the information.

In still another aspect of the disclosure, a liquid ejecting apparatus includes: a liquid tank configured such that a liquid bottle storing a liquid therein is attachable to and removable from the liquid tank, the liquid tank including (i) an inlet through which the liquid in the liquid bottle is poured in a state in which the liquid bottle is attached to the liquid tank and (ii) a liquid storing chamber storing the liquid poured thereinto through the inlet; an image recorder configured to eject the liquid supplied from the liquid storing chamber, so as to record an image on a recording medium; a receiving device configured to receive a bottle remaining-amount signal for determining a bottle remaining amount which is a liquid remaining amount in the liquid bottle attached to the inlet; a tank remaining-amount output device configured to output a tank remaining-amount signal for determining a tank remaining amount which is a liquid remaining amount in the liquid tank; a storage; a notifying device configured to notify the image recorder and a user of information; and a controller, wherein the controller is configured to: in the state in which the liquid bottle is attached to the liquid tank, determine the bottle remaining amount in the liquid bottle attached to the liquid tank based on the bottle remaining-amount signal received by the receiving device; store the determined bottle remaining amount in the storage; determine the tank remaining amount based on the output tank remaining-amount signal; and when the bottle remaining amount stored in the storage is smaller than or equal to a difference between a maximum capacity of the liquid tank and the determined tank remaining amount, control the notifying device to give the user a remaining-amount pouring notification indicating that the liquid can be poured from the liquid bottle whose bottle remaining amount is stored in the storage.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

Figure 1:
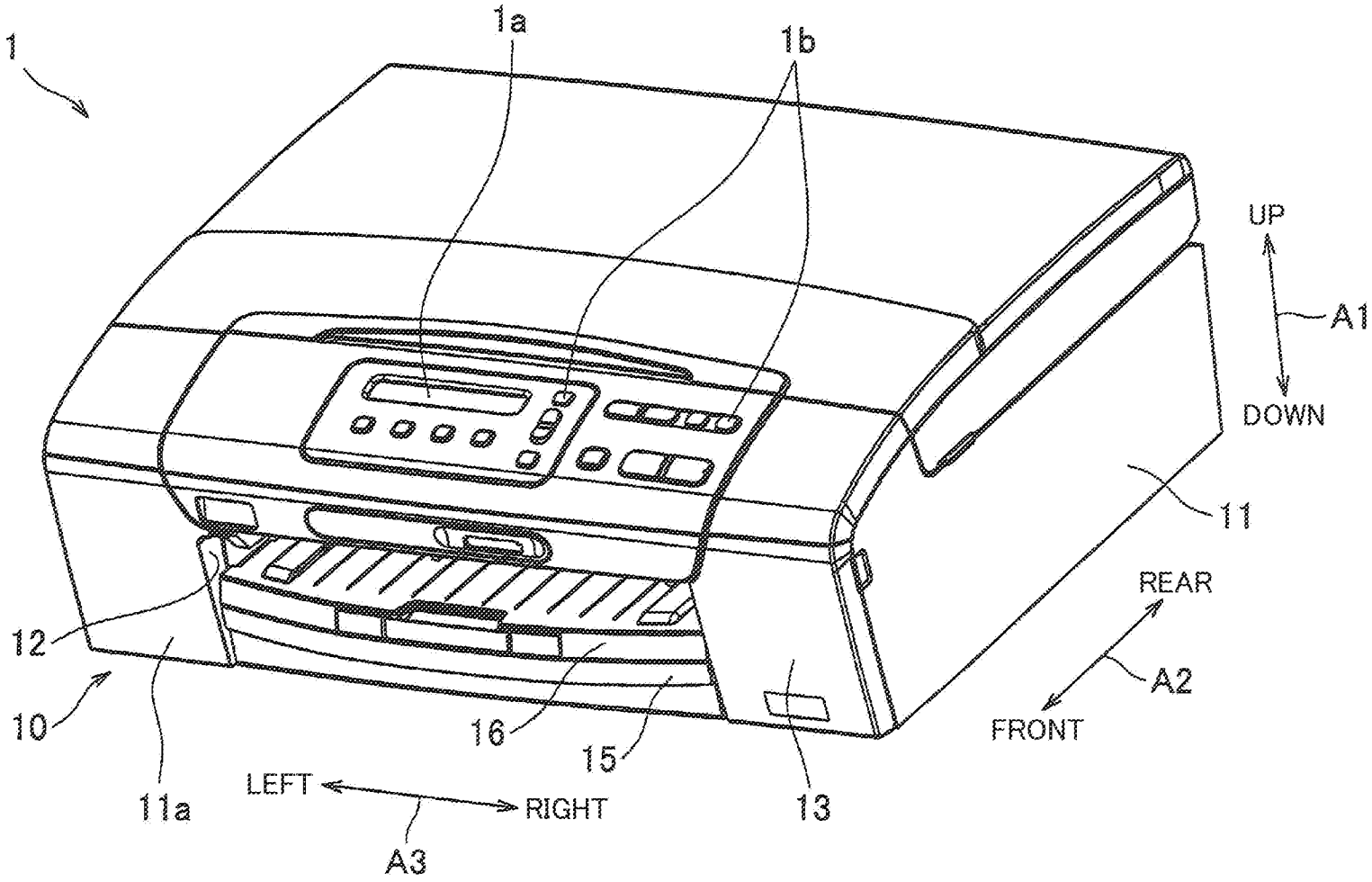
FIG. 1 is a perspective view of a multi-function peripheral (MFP) according to a first embodiment.

A multi-function peripheral (MFP) 1 (as one example of a liquid ejecting apparatus) according to a first embodiment will now be described. The MFP 1 is normally used in a state shown in FIG. 1. In the present embodiment, three directions indicated by arrows in FIG. 1 are an up-down direction A1, a front-rear direction A2, and a right-left direction A3, respectively. The three directions in FIG. 1 are similarly indicated in other drawings.

Outline of MFP 1

Figure 7:
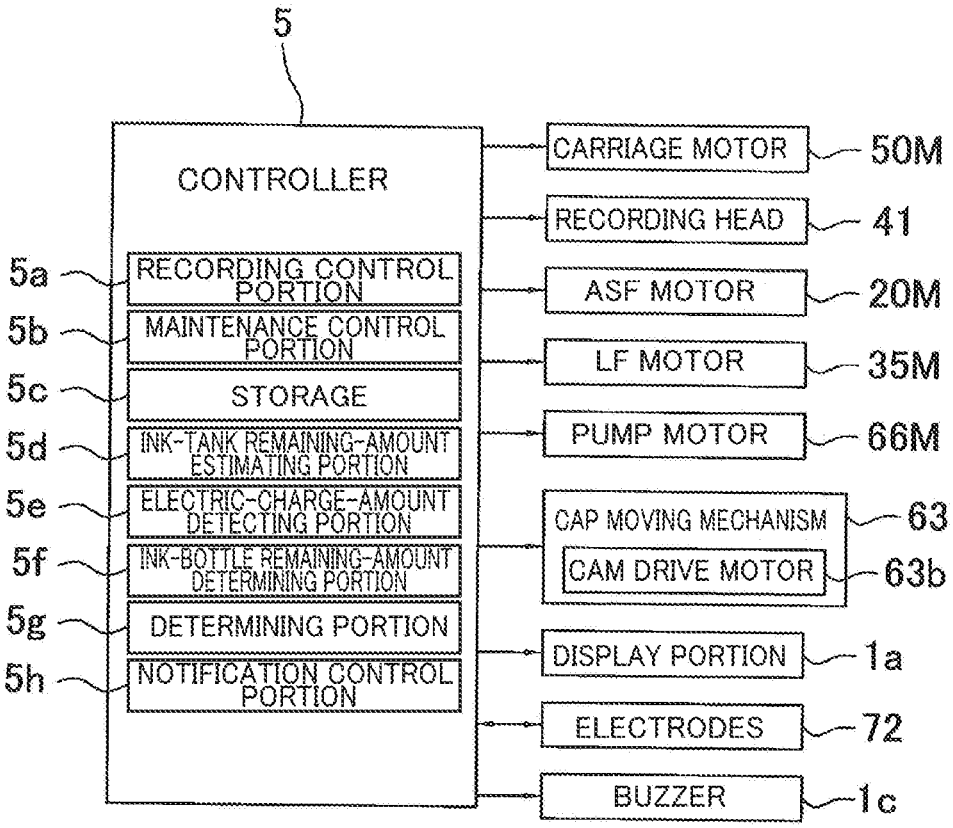
FIG. 7 is a block diagram of a controller.

As shown in FIG. 1, the MFP 1 has a generally thin rectangular parallelepiped shape. The MFP 1 includes, on its upper surface, a display portion 1*a* and operation buttons (as one example of an input device) 1*b*. The MFP 1 further includes therein a buzzer 1*c* (FIG. 7). The display portion (as one example of a notifying device) 1*a* is a display on which information to a user is displayed. The display portion 1*a* is controlled by a controller 5 which will be explained. The buzzer (as one example of a notifying device) 1*c* is also controlled by the controller 5 to generate a warning sound to warn the user. The printing portion 10 is disposed in a lower portion of the MFP 1. The MFP 1 has various functions including a scanning function and a printing function.

The printing portion 10 includes a housing 11. An opening 12 is formed at a substantially central portion of a front wall 11*a* of the housing 11. A sheet supply tray 15 and a sheet discharge tray 16 are stacked on each other. The sheet supply tray 15 is insertable and removable through the opening 12 in the front-rear direction A2. In other words, the sheet supply tray 15 is mountable on and removable from the housing 11. Sheets Pin a desired size are placed on the sheet supply tray 15. The MFP 1 is connectable to an external apparatus such as a personal computer (hereinafter referred to as "PC" where appropriate). The MFP 1 performs a recording operation based on a recording command from a scanner and the PC. Further, the MFP 1 executes various functions in response to an operation on the operation buttons 1*b* by the user.

As shown in FIG. 1, the front wall 11*a* of the housing 11 has, at its right portion, an open/close cover 13. The open/close cover 13 is pivotable at its lower end about a rotation axis extending in the right-left direction A3. When the open/close cover 13 is closed, it faces an ink tank unit 19 (FIG. 3) in the front-rear direction A2. When the open/close cover 13 is opened, an ink tank 18 of the ink tank unit 19 is refillable with the ink.

Internal Structure of Printing Portion 10

Figure 2:
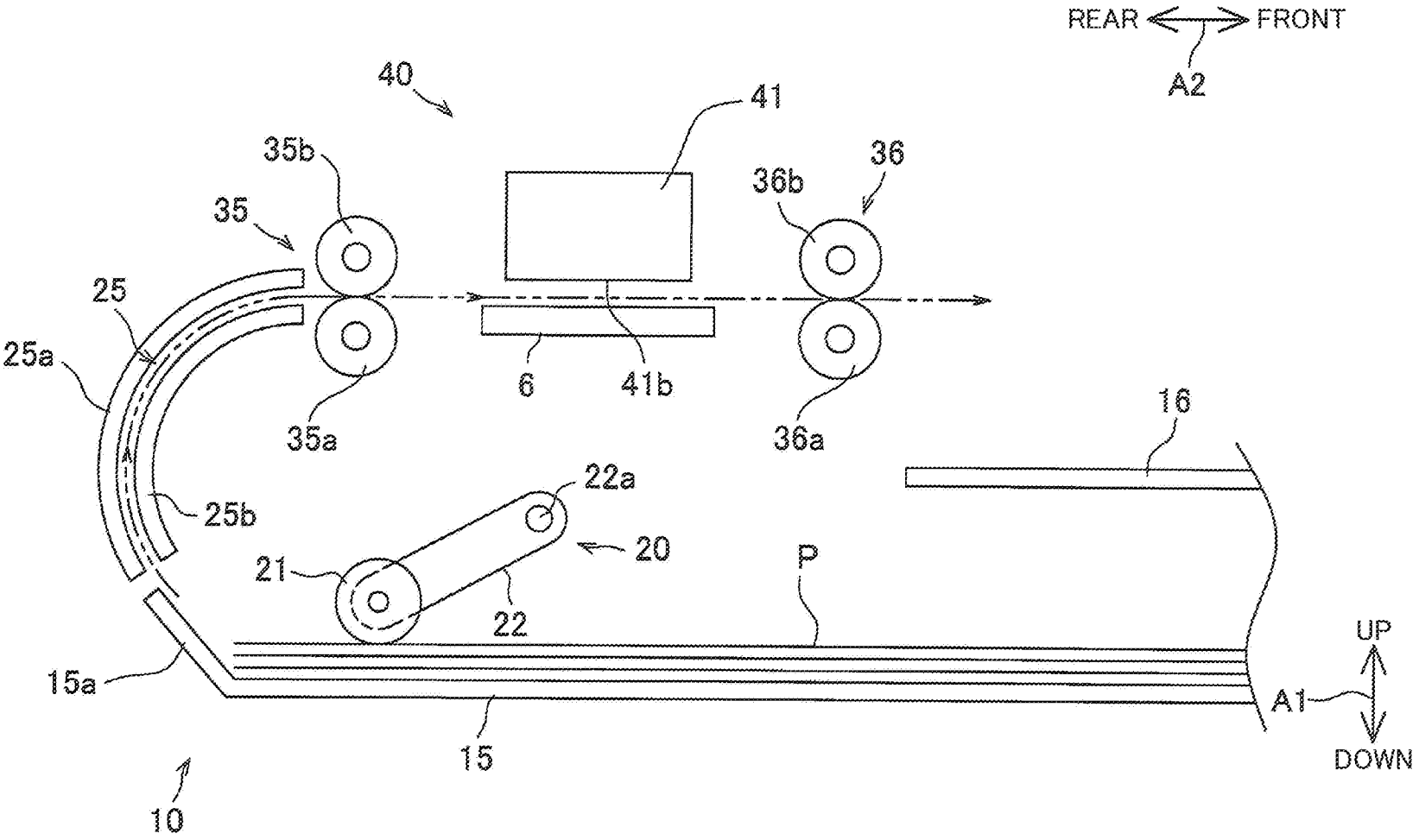
FIG. 2 is a schematic side view showing an internal structure of a printing portion of the MFP shown in FIG. 1.
Figure 3:
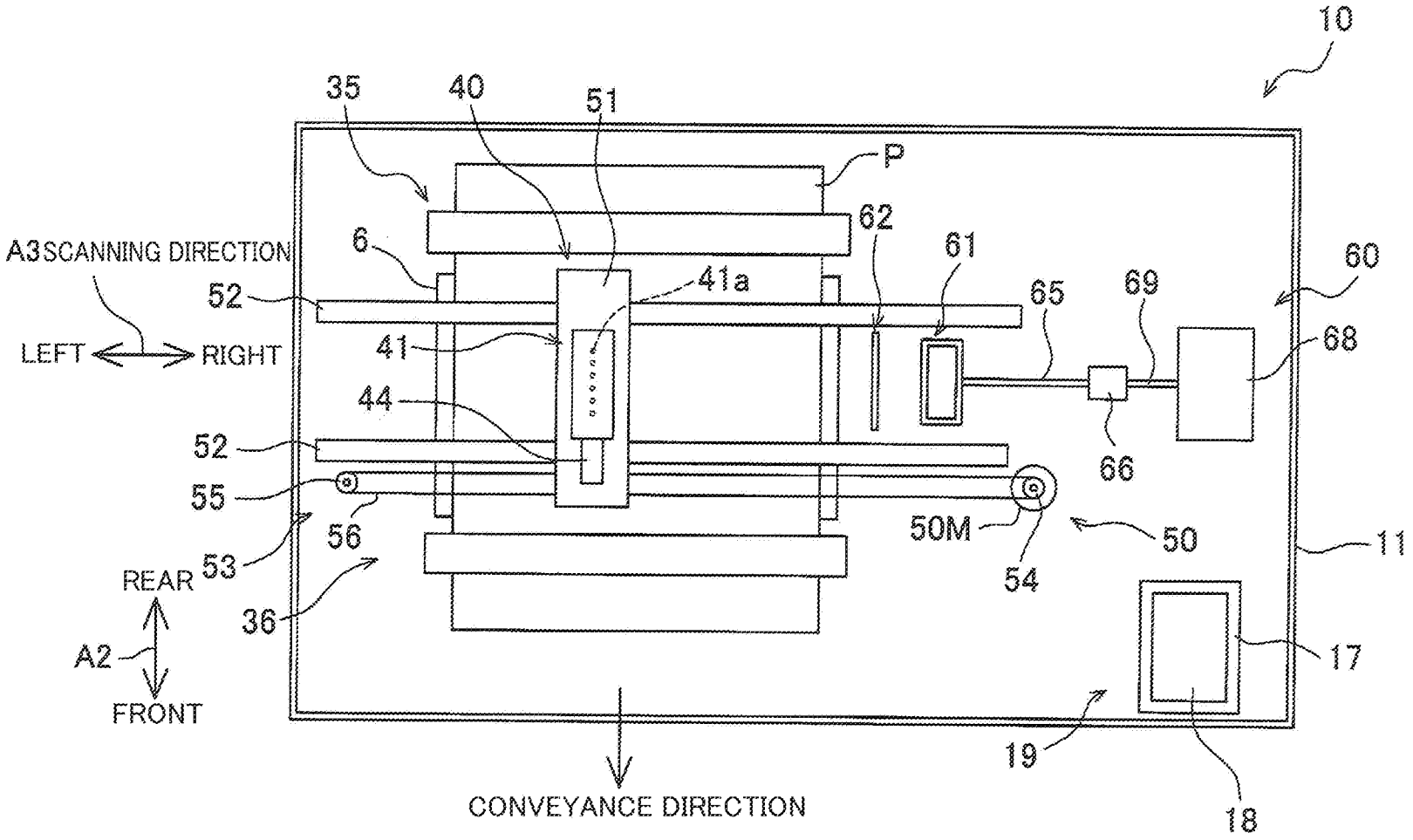
FIG. 3 is a schematic plan view of the printing portion.

An internal structure of the printing portion 10 will now be explained. As shown in FIGS. 2 and 3, the printing portion 10 includes a sheet supplying portion 20, a conveyance roller pair 35, a recording portion 40, the ink tank unit 19, a discharge roller pair 36, an auto sheet feed (ASF) motor 20M (FIG. 7), a line feed (LF) motor 35M (FIG. 7), a maintenance portion 60, and the controller 5 (FIG. 7). The sheet supplying portion 20 supplies the sheet P on the sheet supply tray 15 to a conveyance path 25. The conveyance roller pair 35 conveys, to the recording portion 40, the sheet P supplied from the sheet supplying portion 20. The recording portion 40 is of an ink-jet recording type, for instance. The recording portion 40 records an image on the sheet P conveyed by the conveyance roller pair 35. The discharge roller pair 36 discharges, to the sheet discharge tray 16, the sheet P on which an image has been recorded by the recording portion 40.

Ink Tank Unit 19

The ink tank unit 19 includes a holder 17 and the ink tank 18. As shown in FIG. 3, the holder 17 is disposed at a front right portion in the housing 11. The holder 17 holds the ink tank 18 storing black ink.

Figure 4:
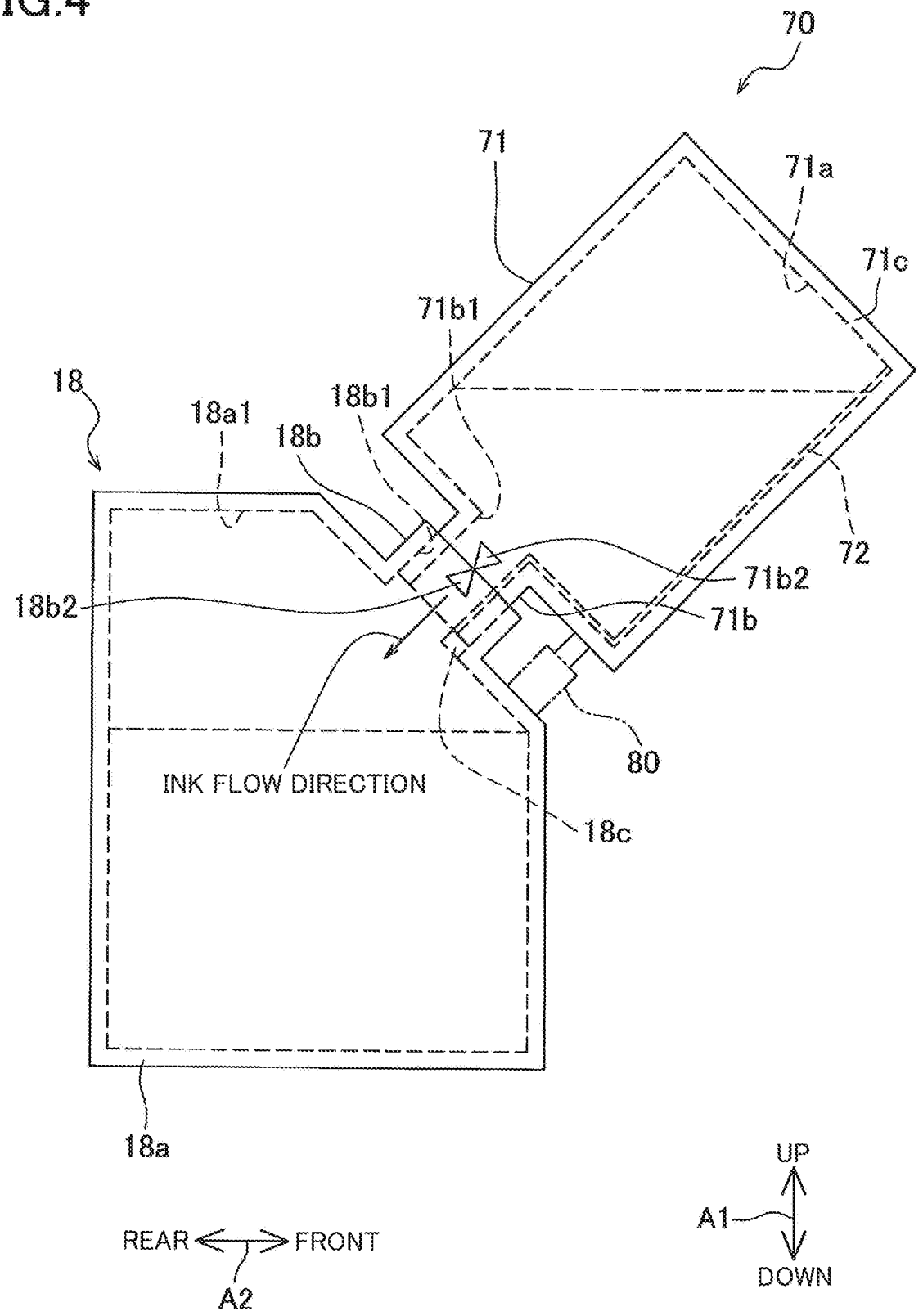
FIG. 4 is a side view showing a state in which an ink bottle is attached to an ink tank shown in FIG. 3.

As shown in FIG. 4, the ink tank 18 includes a tank body 18*a* having an ink chamber (as one example of a liquid storing chamber) 18*a*1 storing the ink therein. The tank body 18*a* has, at its front upper portion, an inlet portion 18*b* for pouring the ink into the ink chamber 18*a*1. The inlet portion 18*b* is a cylindrical member protruding obliquely frontward and has an inlet 18*b*1 formed therein. The inlet portion 18*b* has connection terminals 18*c* connected to the controller 5 by wires not shown. FIG. 4 shows a state in which an ink bottle 70 (which will be described) is attached to the ink tank 18. In a state in which the ink bottle 70 is not attached to the ink tank 18, the inlet 18*b*1 is closed by a lid not shown.

Figure 5:
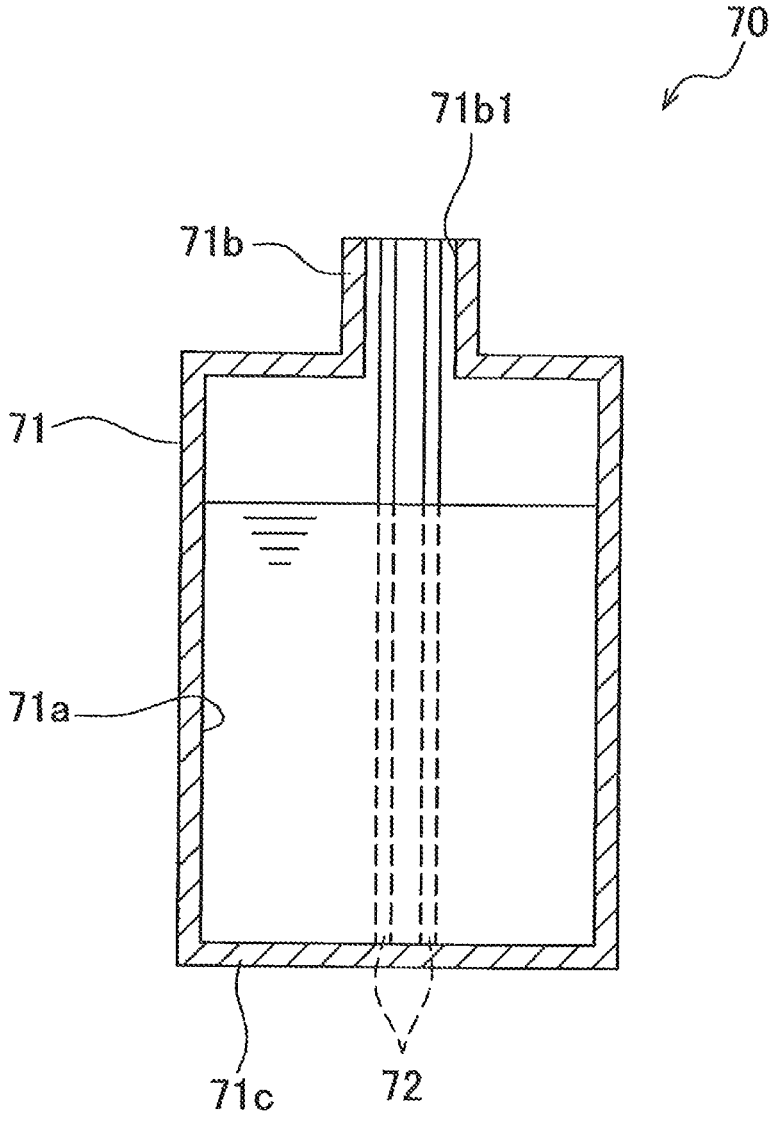
FIG. 5 is a cross-sectional view of the ink bottle shown in FIG. 4 in a state in which the ink bottle stands upright with its outlet facing upward.

The MFP 1 includes the ink bottle 70 for refilling the ink tank 18 with ink. As shown in FIGS. 4 and 5, the ink bottle 70 includes a bottle body 71 having an ink chamber 71*a* storing ink therein. A cylindrical outlet portion 71*b* is formed at one end of the bottle body 71 opposite to a bottom portion 71*c* thereof. The outlet portion 71*b* has an outlet 71*b*1 for discharging the ink stored in the ink chamber 71*a*. The outlet portion 71*b* has an outside diameter that enables the outlet portion 71*b* to be engaged with the inlet 18*b*1. Thus, the ink bottle 70 is attachable to and detachable from the ink tank 18. When the ink bottle 70 is attached to the ink tank 18 such that the outlet portion 71*b* comes into engagement with the inlet 18*b*1, the ink in the ink bottle 70 flows in an ink flow direction indicated by an arrow in FIG. 4, so that the ink is poured into the ink tank 18.

The inlet portion 18*b* of the ink tank 18 is formed such that, when the ink bottle 70 is attached to the inlet portion 18*b*, the flow direction of the ink inclines obliquely with respect to the up-down direction A1 and the front-rear direction A2. This configuration enables the ink in the ink bottle 70 to be smoothly discharged therefrom through the outlet 71*b*1, so that the ink is poured into the ink tank 18 through the inlet 18*b*1. The ink bottle 70 may be formed such that a side portion of the bottle body 71 of the ink bottle 70 has flexibility. In this case, the user grasps and presses the side portion to pour the ink in the ink chamber 71*a* into the ink tank 18 through the outlet 71*b*1 and the inlet 18*b*1.

As shown in FIGS. 4 and 5, a pair of electrodes 72 are provided on an inner surface the bottle body 71. The electrodes (as one example of a remaining-amount detecting sensor) 72 are parallelly spaced apart from each other, as shown in FIG. 5. In the present embodiment, a distance between the two electrodes 72 is smaller than or equal to a diameter of the outlet 71*b*1, as shown in FIG. 5. The distance may be suitably changed. The pair of electrodes 72 may be provided helically along the inner surface of the bottle body 71.

In a state in which the ink bottle 70 stands upright with the outlet 71*b*1 facing upward as shown in FIG. 5, the pair of electrodes 72 extend in the up-down direction A1. That is, the pair of electrodes 72 extend along a direction in which a center axis of the outlet portion 71*b* extends. Thus, in the state in which the ink bottle 70 is attached to the ink tank 18, the pair of electrodes 72 extend along the ink flow direction, as shown in FIG. 4.

As shown in FIG. 4, triangular positioning marks 18*b*2, 71*b*2 are respectively formed on an outer circumferential surface of the inlet portion 18*b* of the ink tank 18 and an outer circumferential surface of the outlet portion 71*b* of the ink bottle 70. The positioning marks 18*b*2, 71*b*2 respectively formed on the inlet portion 18*b* and the outlet portion 71*b* enable the electrodes 72 to be placed at a lower side portion in the ink bottle 70 when the ink bottle 70 is attached to and positioned with respect to the ink tank 18 by butting tips of the respective triangular positioning marks 18*b*2, 71*b*2 against each other. When the ink bottle 70 is attached to the ink tank 18 such that the positioning marks 18*b*2, 71*b*2 are lined up, the connection terminals 18*c* of the ink tank are brought into electrical connection with the respective electrodes 72 of the ink bottle 70. Thus, a suitable voltage is applicable from the controller 5 to the pair of electrodes 72. That is, an electric field is applicable between the two electrodes 72. According to this configuration, an electric charge amount accumulated between the electrodes 72 in the ink of the ink bottle 70 can be determined by the controller 5, whereby an ink remaining amount in the ink bottle 70 can be determined.

Sheet Supplying Portion 20

As shown in FIG. 2, the sheet supplying portion 20 is disposed above the sheet supply tray 15. The sheet supplying portion 20 includes a sheet supply roller 21 and an arm 22. The sheet supply roller 21 is rotatably supported at a distal end of the arm 22. The arm 22 is pivotally supported by a support shaft 22*a* and biased by a spring or the like to pivot downward such that the sheet supply roller 21 contacts the sheet supply tray 15. The arm 22 is retractable upward when the sheet supply tray 15 is inserted and removed. The sheet supply roller 21 is rotated by a force of the ASF motor 20M transmitted via a transmission mechanism (not shown), so that the sheet P in the sheet supply tray 15 is supplied to the conveyance path 25.

Sheet Supply Tray 15

As shown in FIG. 2, the sheet supply tray 15 includes an inclined wall portion 15*a*. When the sheet P is supplied from the sheet supply tray 15 by the sheet supply roller 21, the inclined wall portion 15*a* guides the sheet P to the conveyance path 25.

Conveyance Path 25

As shown in FIG. 2, the conveyance path 25 is defined by an outer guide 25*a* and an inner guide 25*b* opposed to each other with a predetermined spacing therebetween. The conveyance path 25 extends upward from a rear end of the sheet supply tray 15 and curves frontward toward the printing portion 10. The sheet P supplied from the sheet supply tray 15 is guided by the conveyance path 25 so as to be conveyed upward while making a U turn and reaches the recording portion 40.

Conveyance Roller Pair 35 and Discharge Roller Pair 36

The conveyance roller pair 35 includes a lower conveyance roller 35*a* and an upper pinch roller 35*b*. The conveyance roller 35*a* is rotated by a force of the LF motor 35M transmitted via a transmission mechanism (not shown). The pinch roller 35*b* is rotated by rotation of the conveyance roller 35*a*. The conveyance roller 35*a* and the pinch roller 35*b* cooperate with each other to nip the sheet P therebetween in the up-down direction A1, so as to convey the sheet P to the recording portion 40.

The discharge roller pair 36 includes a lower discharge roller 36*a* and an upper spur roller 36*b*. The discharge roller 36*a* is rotated by a force of the LF motor 35M transmitted via a transmission mechanism (not shown). The spur roller 36*b* is rotated by rotation of the discharge roller 36*a*. The discharge roller 36*a* and the spur roller 36*b* cooperate with each other to nip the sheet P therebetween in the up-down direction A1, so as to convey the sheet P to the sheet discharge tray 16.

Recording Portion 40

As shown in FIGS. 2 and 3, the recording portion 40 (as one example of an image recorder) includes a recording head 41, a head moving mechanism 50, and a platen 6. The head moving mechanism 50 includes a carriage 51. The carriage 51 is configured to reciprocate in a scanning direction (the right-left direction A3) orthogonal to a conveyance direction of the sheet P. The recording head 41 is supported by the carriage 51.

A lower surface of the recording head 41 is an ejection surface 41*b* in which are formed a plurality of ejection openings 41*a* from which the ink is ejected to the sheet P conveyed below the recording head 41. As shown in FIG. 3, the ejection openings 41*a* are arranged in the conveyance direction. The recording head 41 ejects the ink from the ejection openings 41*a* as minute ink droplets, under the control of the controller 5 based on the recording command.

A tube joint 44 is provided integrally with the recording head 41. The recording head 41 and the ink tank 18 are connected via a flexible tube (not shown) connected to the tube joint 44, so that the ink is supplied to the recording head 41. The recording head 41 is disposed at a height level in the up-down direction A1 higher than the ink tank 18. Thus, there is applied, to the ink in the recording head 41, a negative pressure corresponding to a head difference between the recording head 41 and the ink tank 18. Discharging of the ink from the recording head 41 causes the ink in the ink tank 18 to be automatically supplied to the recording head 41. A supply of the ink performed in an ink refilling from the ink bottle 70 to the ink tank 18 is automatically performed upon attachment of the ink bottle 70 to the ink tank 18 and is thus performed independently of a supply of the ink from the ink tank 18 to the recording head 41 that arises from an ejection of the ink from the recording head 41.

The platen 6 is disposed under the recording head 41 for supporting the sheet P conveyed by the conveyance roller pair 35. The platen 6 is located at a portion in a reciprocating movement range of the carriage 51 over which the sheet P passes. The platen 6 has a width sufficiently larger than a width of the sheet P having the largest width among the sheets P conveyable. Thus, the sheet P conveyed through the conveyance path 25 always passes on the platen 6.

As shown in FIG. 3, the head moving mechanism 50 includes a pair of guide rails 52 and a belt transmission mechanism 53. The guide rails 52 are spaced apart from each other in the front-rear direction A2 and extend in the right-left direction A3 so as to be parallel to each other. The carriage 51 is disposed straddling the guide rails 52 and reciprocates on the guide rails 52 in the right-left direction A3.

The belt transmission mechanism 53 includes two pulleys 54, 55, an endless timing belt 56 a part of which is fixed to the carriage 51, and a carriage motor 50M. The two pulleys 54, 55 are spaced from each other in the right-left direction A3, and the timing belt 56 is looped over the pulleys 54, 55. The pulley 54 is connected to a drive shaft of the carriage motor 50M. When the carriage motor 50M is driven, the timing belt 56 moves, and the recording head 41 moves with the carriage 51 in the scanning direction.

The recording head 41 ejects the ink from the ejection openings 41*a* under the control of the controller 5 based on the recording command. That is, when the carriage 51 reciprocates in the right-left direction A3, the recording head 41 moves with respect to the sheet P and ejects the ink from the ejection openings 41*a*, so that an image is recorded on the sheet P conveyed on the platen 6. The printing portion 10 is provided with a linear encoder (not shown) having a multiplicity of light transmitting portions (slits) arranged so as to be spaced apart from one another in the scanning direction. The carriage 51 is provided with a transmission-type position detecting sensor (not shown) having a light emitting element and a light receiving element. The printing portion 10 is configured to recognize a current position of the carriage 51 in the scanning direction based on a count value of the light transmitting portions of the linear encoder detected by the position detecting sensor during the movement of the carriage 51, and rotational driving of the carriage motor 50M is controlled.

Maintenance Portion 60

Figure 6:
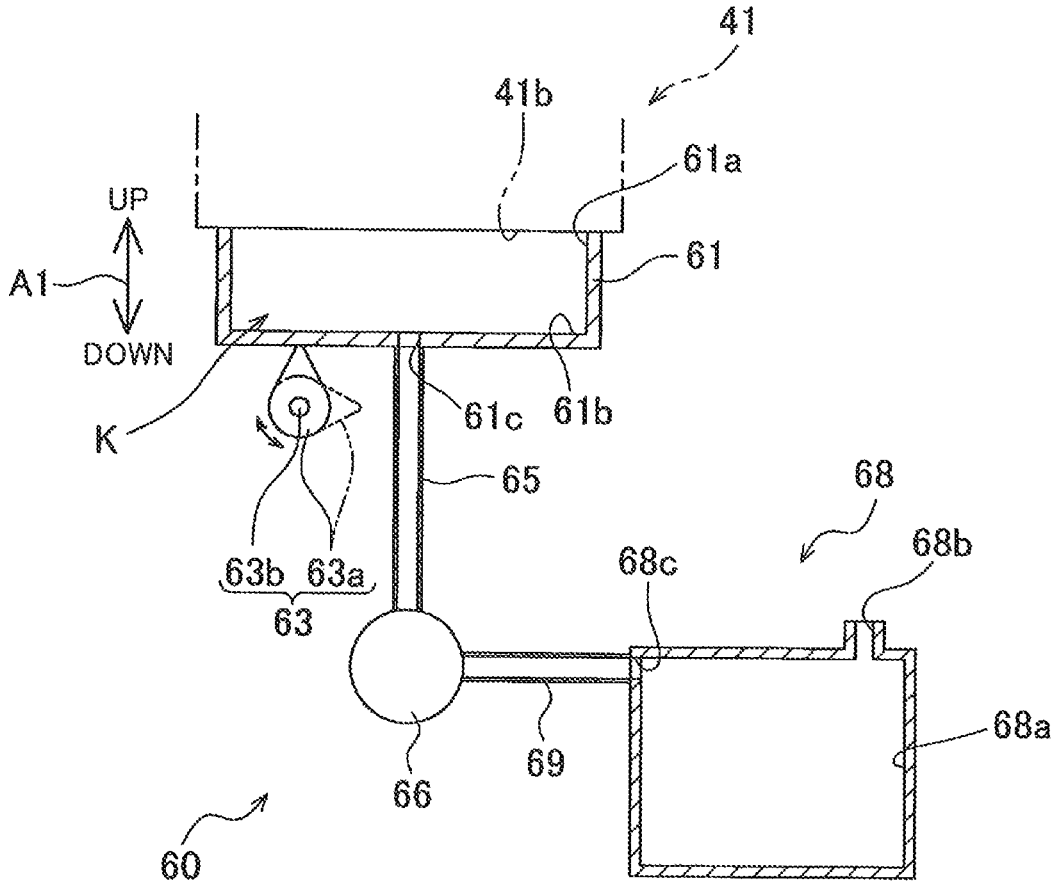
FIG. 6 is a schematic cross-sectional view of a maintenance portion shown in FIG. 3.

The maintenance portion 60 will now be explained with reference to FIGS. 3 and 6. The maintenance portion 60 permits the ink to be discharged from the ejection openings 41*a* formed in the ejection surface 41*b* to remove air bubbles in the recording head 41 and the thickened ink in the ejection openings 41*a* and to remove foreign matters such as paper dust and starch adhering around the ejection openings 41*a*. As shown in FIGS. 3 and 6, the maintenance portion 60 is disposed to the right of the platen 6. The maintenance portion 60 includes a cap 61, a wiper 62, a cap moving mechanism 63, a pump 66, and a waste liquid tank 68.

The cap 61 is formed of a material having flexibility such as rubber or synthetic resin. As shown in FIG. 6, the cap 61 has a recess 61*a* opening toward the ejection surface 41*b* of the recording head 41 when the recording head 41 is located at a maintenance position (which is on the right side of the platen 6 and at which the recording head 41 is opposed to the cap 61). As shown in FIG. 6, the cap 61 is formed to be contactable, at an upper peripheral end of the recess 61*a*, with a peripheral portion of the ejection surface 41*b* of the recording head 41 located at the maintenance position. Thus, when the cap 61 comes into contact with the ejection surface 41*b*, namely, in a contact state of the cap 61 and the ejection surface 41*b*, the ejection openings 41*a* are covered by the cap 61. The cap 61 has a communication hole 61*c* formed in its inner bottom surface 61*b*.

As shown in FIG. 3, the wiper 62 is disposed to the left of the cap 61. The wiper 62 is shaped like a plate and formed of a material having flexibility such as rubber or synthetic resin. The wiper stands upright in the up-down direction A1. The wiper 62 has a dimension in the front-rear direction A3 larger than that of the ejection surface 41*b*. The wiper 62 is moved by a wiper moving mechanism (not shown) between a wiping position and a standby position lower than the wiping position. The wiping position is a position at which a distal end of the wiper 62 is located at a height level slightly higher than the ejection surface 41*b* in the up-down direction A1. When the recording head 41 passes the wiper 62 together with the carriage 51 in a state in which the wiper 62 is located at the wiping position, the ejection surface 41*b* is wiped by the wiper 62. The standby position is a position at which the distal end of the wiper 62 is located at a height level lower than the ejection surface 41*b* in the up-down direction A1.

As shown in FIG. 6, the cap moving mechanism 63 includes a cam 63*a* and a cam drive motor 63*b*. The cam 63*a* is disposed such that its outer circumferential surface is in contact with a lower surface of the cap 61. The cam 63*a* has a particular contour and is rotatingly driven by a cam drive motor 63*b*.

As shown in FIG. 6, when the cam 63*a* is rotated counterclockwise by 90° from the posture indicated by the long dashed double-short dashed line in FIG. 6 in a state in which the ejection surface 41*b* of the recording head 41 is opposed to the cap 61, the cap 61 is pushed up following the contour of the cam 63*a*. As a result, the contact state is established in which the cap 61 is in contact with the ejection surface 41*b* while covering the ejection openings 41*a*, so that an internal space K is defined by the recess 61*a* and the ejection surface 41*b*. When the cam 63*a* is rotated clockwise by 90° from the contact state, the cap 61 moves downward following the contour of the cam 63*a*. As a result, a spaced state is established in which the cap 61 is spaced apart from the ejection surface 41*b*.

A pipe 65 is connected at one end thereof to the communication hole 61*c* of the cap 61 and at the other end thereof to the pump 66. The pipe 65 permits the internal space K and the pump 66 to communicate with each other. The pump 66 is a known tube pump. The pressure in the pipe 65 is reduced by forwardly rotating a rotor of the pump 66. That is, by reducing the pressure in the pipe 65 in the state in which the cap 61 is in contact with the ejection surface 41*b*, a predetermined amount of the ink in the recording head 41 can be discharged from the ejection openings 41*a* by sucking. The pump 66 is rotated by driving a pump motor 66M (FIG. 7) connected to the rotor.

A pipe 69 is connected at one end thereof to the pump 66 and at the other end thereof to a communication hole 68*c* of the waste liquid tank 68. The waste liquid tank 68 includes a storing portion 68*a*, an atmosphere communication passage 68*b* through which the storing portion 68*a* communicates with the atmosphere, and a communication hole 68*c* through which the pipe 69 and the storing portion 68*a* communicate with each other. The atmosphere communication passage 68*b* is formed at an upper end of the storing portion 68*a*. The storing portion 68*a* of the waste liquid tank 68 stores waste ink sucked from the recording head 41 by the pump 66.

As shown in FIG. 7, the controller 5 includes a recording control portion 5*a*, a maintenance control portion 5*b*, a storage 5*c*, an ink-tank remaining-amount estimating portion 5*d*, an electric-charge-amount detecting portion 5*e*, an ink-bottle remaining-amount determining portion 5*f*, a determining portion 5*g*, and a notification control portion 5*h*. The controller 5 includes a central processing unit (CPU), a read only memory (ROM), a random access memory (RAM), an application specific integrated circuit (ASIC), an electrically erasable programmable read only memory (EEPROM) which cooperate with one another to constitute the functional portions described above. The controller 5 of the present embodiment includes the single CPU and the single ASIC. The controller 5 may include the single ASIC that executes necessary processes solely or may include a plurality of ASICs that share execution of necessary processes.

Based on the recording command (image data) sent from the scanner or the PC, the recording control portion 5*a* controls operations of the ASF motor 20M and the LF motor 35M to convey the sheet P and controls operations of the carriage motor 50M and the recording head 41 to record an image on the conveyed sheet P. Based on a maintenance command sent from the PC or the like, the maintenance control portion 5*b* controls the carriage motor 50M, the cam drive motor 63*b*, and the pump motor 66M to perform maintenance operations such as an ink discharging operation to discharge a predetermined amount of the ink from the ejection openings 41*a* for discharging the air bubbles and the thickened ink and a removal operation to remove the foreign matters (such as paper dust and starch) adhering to the ejection surface 41*b*.

The storage 5*c* stores a tank capacity of the ink tank 18, a remaining amount of the ink (ink remaining amount) in the ink tank 18, and a remaining amount of the ink (ink remaining amount) in the ink bottle 70. Further, the storage 5*c* stores an electric charge amount detected between the pair of electrodes 72 when the ink bottle 70, which is filled with a full amount of the ink, is attached to the ink tank 18. That is, the storage 5*c* stores an ink-full electric charge amount which is an electric charge amount when the ink bottle 70 is full.

The ink-tank remaining-amount estimating portion 5*d* calculates an amount of the ink consumed by discharging the ink from the ejection openings 41*a* of the recording head 41. The ink-tank remaining-amount estimating portion 5*d* starts calculating the amount of consumption of the ink from a state, as an initial value, in which the ink tank 18 is fully filled with the ink. Specifically, when the user refills the ink tank 18 with the ink such that the ink tank 18 becomes full and pushes a reset button (not shown), the ink-tank remaining-amount estimating portion 5*d* performs, for the ink tank 18, initialization of a count value of the ink consumption amount, namely, returns the count value to a value indicating the ink consumption amount of 0 g, for instance. Further, the ink-tank remaining-amount estimating portion 5*d* starts adding up the ink consumption amount. The adding up of the ink consumption amount performed for the ink tank 18 continues until the user again pushes the reset button.

The ink consumption amount calculated by the ink-tank remaining-amount estimating portion 5*d* includes not only an amount of the ink consumed by recording an image on the sheet P but also an amount of the ink consumed by the ink discharging operation for discharging the air bubbles and the thickened ink in the recording head 41. The ink consumption amount is a count value obtained by what is called a dot counting method. That is, in image recording, the ink-tank remaining-amount estimating portion 5*d* multiplies a design ink consumption amount consumed in image recording for one dot by the number of dots based on the image data, so as to calculate a total ink consumption amount consumed in one-pass image recording.

Further, the ink-tank remaining-amount estimating portion 5*d* adds up the ink consumption amount calculated for every one pass from the state, as the initial value, in which the ink tank 18 is fully filled with the ink, so as to calculate the ink consumption amount of the ink tank 18. In the present embodiment, the ink consumption amount is calculated as an ink amount ejected from the ejection openings 41*a* of the recording head 41 for every one pass by which the carriage 51 moves in one scanning operation, namely, an ink amount obtained by multiplying an ink amount for one dot by the number of ejected dots. Further, a total ink consumption amount from the initial value is updated.

The ink amount consumed when the ink discharging operation is performed is calculated as a predetermined ink amount used in every one discharging operation. During image recording, the count value of the ink consumption amount is stored, in the storage 5*c*, as the most recent consumption amount every time the ink of a unit consumption amount is consumed, every time one sheet is discharged, for instance. In the ink discharging operation, the count value of the ink consumption amount is stored, in the storage 5*c*, as the most recent consumption amount every time the ink discharging operation is performed. In this manner, the ink-tank remaining-amount estimating portion 5*d* calculates the count value of the ink consumption amount discharged from the recording head 41 (the ink discharge amount) and stores the calculated count value in the storage 5*c*, thereby estimating the ink remaining amount of the ink tank 18 and stores the ink remaining amount of the ink tank 18 in the storage 5*c*.

The electric-charge-amount detecting portion (as one example of a detection circuit) 5*e* includes the connection terminals 18*c*, an electric charge amount detection circuit connected to the connection terminals 18*c* for detecting the electric charge amount, an A/D conversion circuit, and wires connecting the connection terminals 18*c* and the circuits. The electric-charge-amount detecting portion 5*e* always outputs a predetermined voltage in a state in which the MFP 1 is turned on, such that the predetermined voltage can be applied to the pair of electrodes 72 when the ink bottle 70 is attached to the ink tank 18 by the user. In this configuration, the electric-charge-amount detecting portion 5*e* is capable of detecting the electric charge amount accumulated between the electrodes 72, so as to detect the electric charge amount in a second range which will be explained. In a state in which the ink bottle 70 is not attached to the ink tank 18, the electric-charge-amount detecting portion 5*e* is capable of detecting the electric charge amount to the connection terminals 18*c*, so as to detect the electric charge amount in a first range which will be explained.

The ink-bottle remaining-amount determining portion 5*f* determines the ink remaining amount in the ink bottle 70 based on the electric charge amount between the pair of electrodes 72 detected by the electric-charge-amount detecting portion 5*e*. That is, the ink-bottle remaining-amount determining portion 5*f* calculates a percentage of the electric charge amount between the pair of electrodes 72 detected by the electric-charge-amount detecting portion 5*e* where the ink-full electric charge amount in the ink bottle 70 is represented as 100%, so as to determine the ink remaining amount of the ink bottle 70. The ink-bottle remaining-amount determining portion 5*f* stores, in the storage 5*c*, the determined ink remaining amount in the ink bottle 70.

Figure 8:
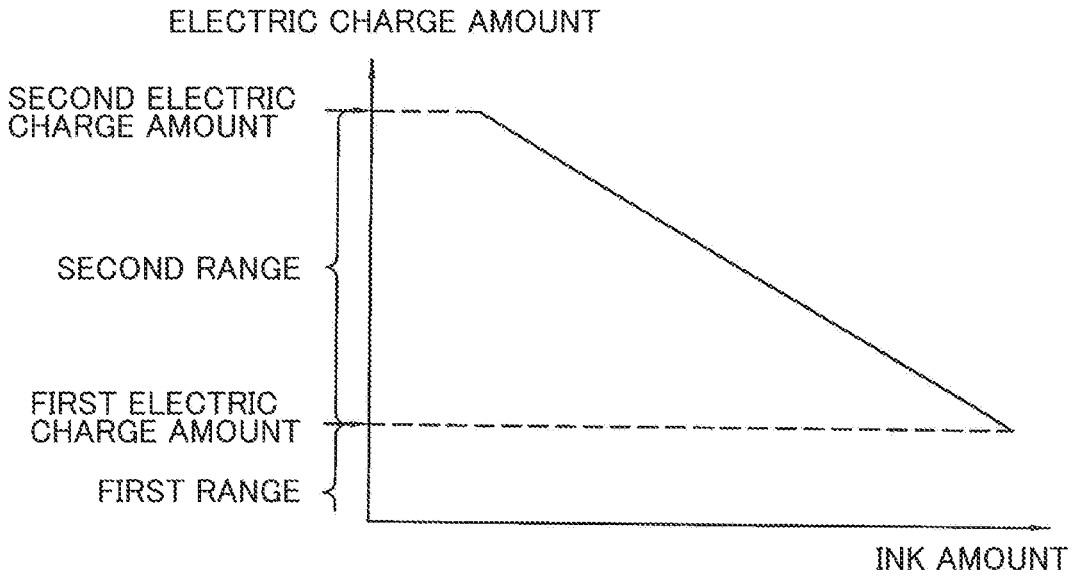
FIG. 8 is a graph showing a change in an electric charge amount over a time period from an ink full state of the ink bottle to an ink empty state of the ink bottle.

Further, the ink-bottle remaining-amount determining portion 5*f* starts the determination of the ink remaining amount in the ink bottle 70 when the electric charge amount detected by the electric-charge-amount detecting portion 5*e* changes from a value in the first range that is up to a first electric charge amount, to a value in the second range larger than a value in the first range, as shown in FIG. 8. FIG. 8 indicates a change in the electric charge amount from a state in which the ink bottle 70 is full (ink full state) to a state in which the ink bottle 70 is empty (ink empty state). In FIG. 8, a vertical axis represents the electric charge amount, and a horizontal axis represents the ink amount. The graph of FIG. 8 indicates that the electric charge amount increases toward up and the ink amount in the ink bottle 70 decreases toward the right. The first electric charge amount is a maximum value of the electric charge amount detected by the electric-charge-amount detecting portion 5*e* in a state in which the ink bottle 70 is not attached to the ink tank 18. The first range is a range up to the first electric charge amount. The second range is a range from beyond the first electric charge amount to the second electric charge amount or smaller. The second electric charge amount is a maximum value of the electric charge amount detected by the electric-charge-amount detecting portion 5*e* in a state in which the ink bottle 70 containing the full amount of the ink is attached to the ink tank 18, i.e., the ink-full electric charge amount. The first and second electric charge amounts are stored in the storage 5*c*.

When the ink is poured into the ink tank 18 from the ink bottle 70 attached thereto, the determining portion 5*g* determines whether the ink remaining amount of the ink bottle 70 has decreased to such an extent that the ink is about to overflow the ink tank 18, based on the ink remaining amount and the tank capacity of the ink tank 18 stored in the storage 5*c* and the ink remaining amount of the ink bottle 70 stored in the storage 5*c*. In other words, the determining portion 5*g* determines, when the ink is poured into the ink tank 18, whether the ink is just about to overflow the ink tank 18 due to an increase in the ink of the ink tank 18 in accordance with a decrease in the ink remaining amount of the ink bottle 70, based on the decrease of the ink remaining amount of the ink bottle 70.

Figure 9:
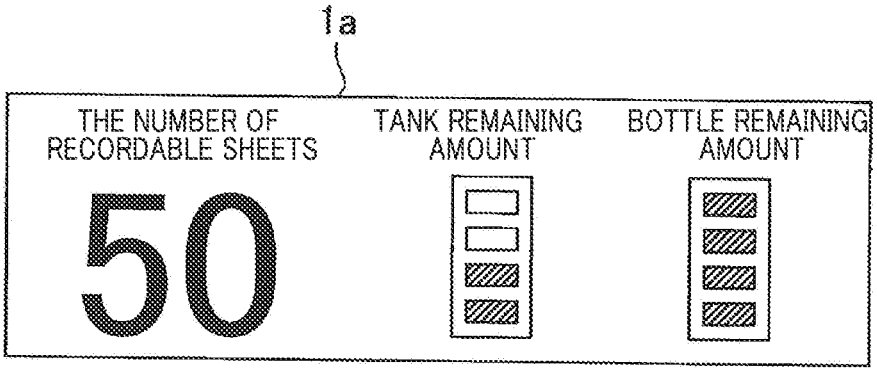
FIG. 9 is a schematic view of a display portion shown in FIG. 1.

The notification control portion 5*h* controls the display portion 1*a* to display the ink remaining amount in the ink tank 18, the ink remaining amount in the ink bottle 70, and the recordable number of sheets, as shown in FIG. 9, based on the ink remaining amount in the ink tank 18 and the ink remaining amount in the ink bottle 70 stored in the storage 5*c*. In the present embodiment, the ink remaining amount in each of the ink tank 18 and the ink bottle 70 is indicated by four levels, as shown in FIG. 9. The ink remaining amount may be indicated in any manner as long as the ink remaining amount can be notified to the user. FIG. 9 shows a state in which a tank remaining amount (i.e., the ink remaining amount in the ink tank 18) is half and a bottle remaining amount (i.e., the ink remaining amount in the ink bottle 70) is full. The recordable number of sheets is the number of sheets P recordable in the case where an image recording operation (a predetermined condition) based on particular image data set in advance is performed by the use of the ink remaining amount in the ink tank 18 and the ink remaining amount in the ink bottle 70 stored in the storage 5*c*. The notification control portion 5*h* determines the recordable number of sheets and displays the determined recordable number of sheets on the display portion 1*a*.

The notification control portion 5*h* controls the display portion 1*a* to display a warning message notifying the user that the ink is about to overflow the ink tank 18 when the determining portion 5*g* determines that the ink remaining amount in the ink bottle 70 is decreased to such an extent that the ink is about to overflow the ink tank 18. On this occasion, the notification control portion 5*h* controls the buzzer 1*c* to generate a warning sound to notify the user that the ink is about to overflow.

In the present embodiment, the notification control portion 5*h* controls the display portion 1*a* to display the ink remaining amounts of the ink tank 18 and the ink bottle 70, the recordable number of sheets, and the message informing the user that the ink is about to overflow. Alternatively, the notification control portion 5*h* may control an external apparatus such as a wiredly or wirelessly connected PC to display the ink remaining amounts of the ink tank 18 and the ink bottle 70, the recordable number of sheets, and the message indicated above.

Figure 10:
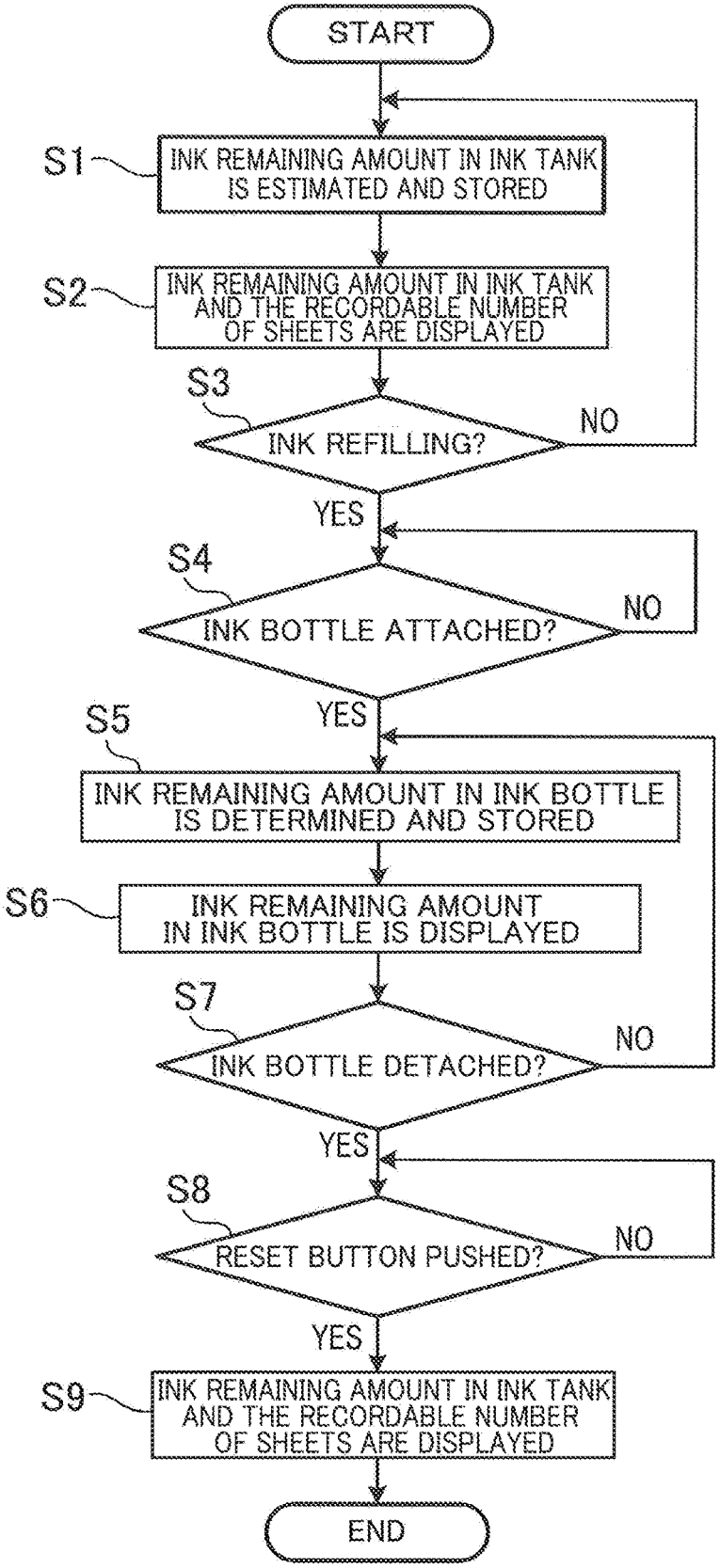
FIG. 10 is a view showing a first control flow of the MFP.
Figure 11:
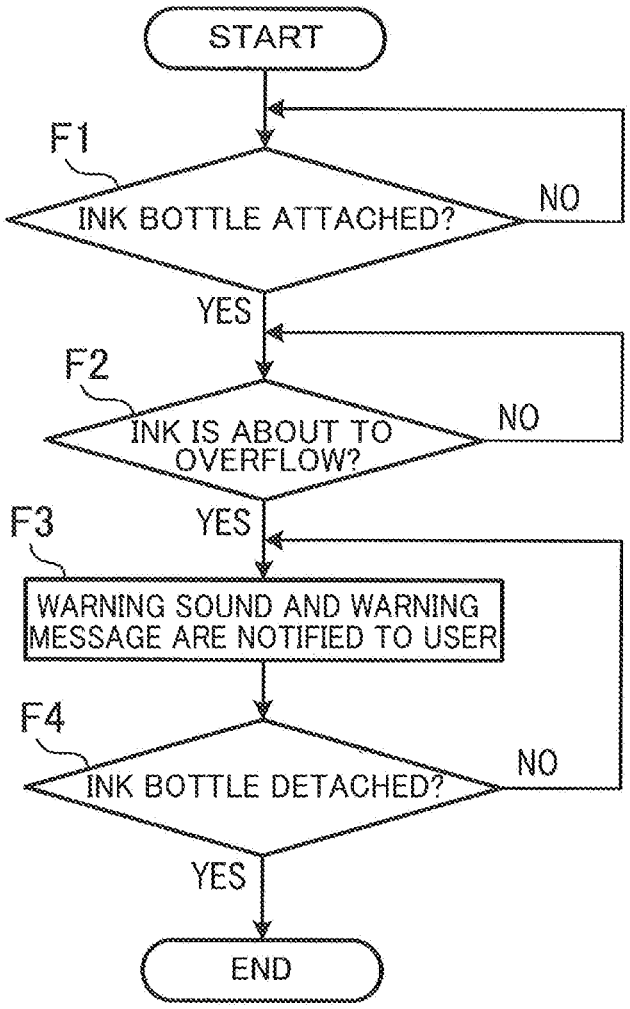
FIG. 11 is a view showing a second control flow of the MFP.

Referring next to FIGS. 10 and 11, a first control flow and a second control flow of the MFP 1 will be explained. The first control flow is mainly for estimating the ink remaining amount in the ink tank 18 and determining the ink remaining amount in the ink bottle 70. The second control flow is mainly for determining whether the ink overflow from the ink tank 18 occurs when the ink is poured into the ink tank 18. The first control flow is initially explained below.

As shown in FIG. 10, at Step S1 of the first control flow, the ink-tank remaining-amount estimating portion 5*d* calculates the count value of the ink consumption amount when the image recording is performed on the sheet P and when the ink discharging operation for maintenance is performed, and stores the calculated count value in the storage 5*c*. That is, the ink-tank remaining-amount estimating portion 5*d* estimates the ink remaining amount in the ink tank 18 (liquid remaining amount estimating process) and stores the estimated ink remaining amount in the storage 5*c* (liquid-tank remaining amount storing process).

At Step S2, based on the ink remaining amount in the ink tank 18 stored in the storage 5*c*, the notification control portion 5*h* controls the display portion 1*a* to display the ink remaining amount. Further, the notification control portion 5*h* determines the recordable number of sheets based on the ink remaining amount in the ink tank 18 stored in the storage 5*c* and the ink remaining amount in the ink bottle 70 which will be explained, and displays the determined recordable number of sheets on the display portion 1*a* (the number of sheets displaying process).

At Step S3, the controller 5 determines whether the ink remaining amount in the ink tank 18 estimated and stored by the ink-tank remaining-amount estimating portion 5*d* has reached an amount indicative of empty, namely, whether the count value of the ink consumption amount has reached a maximum value. When the ink remaining amount in the ink tank 18 has reached the amount indicative of empty (S3: YES), the control flow goes to Step S4. On the other hand, when the ink remaining amount in the ink tank 18 does not yet reach the amount indicative of empty (S3: NO), the control flow returns to Step S1. When going to Step S4, the controller 5 controls the buzzer 1*c* and the display portion 1*a* to give the user a notification to refill the ink tank 18 with the ink.

When the user refills the ink tank 18 with the ink, the user attaches the ink bottle 70 to the ink tank 18 with the positioning marks 18*b*2, 71*b*2 lined up, as shown in FIG. 4. As a result, the connection terminals 18*c* and the pair of electrodes 72 are brought into electrical connection with each other, so that the electric charge amount detected by the electric-charge-amount detecting portion 5*e* changes from a value in the first range to a value in the second range. That is, when the electric charge amount changes from a value in the first range to a value in the second range at Step S4 (S4: YES), the control flow goes to Step S5. On the other hand, when the ink bottle 70 is not attached to the ink tank 18, the electric charge amount detected by the electric-charge-amount detecting portion 5*e* falls within the first range. That is, when the electric charge amount falls within the first range at Step S4 (S4: NO), Step S4 is repeated.

At Step S5, the ink-bottle remaining-amount determining portion 5*f* starts the determination of the ink remaining amount in the ink bottle 70 in response to the change of the electric charge amount detected by the electric-charge-amount detecting portion 5*e* from a value in the first range to a value in the second range. The ink-bottle remaining-amount determining portion 5*f* determines the ink remaining amount as explained above (liquid remaining amount determining process), and stores the determined ink remaining amount in the storage 5*c* (liquid-bottle remaining amount storing process).

At Step S6, the notification control portion 5*h* controls the display portion 1*a* to display the ink remaining amount (remaining-amount information notifying process), based on the ink remaining amount in the ink bottle 70 stored in the storage 5*c*.

At Step S7, the controller 5 determines whether the ink bottle 70 is detached from the ink tank 18. In the case where the user detaches the ink bottle 70 from the ink tank 18 based on information given by execution of the second flow (which will be explained) and indicating that the ink overflow will occur, the electrical connection between the connection terminals 18*c* and the pair of electrodes 72 is canceled, so that the electric charge amount detected by the electric-charge-amount detecting portion 5*e* changes from a value in the second range to a value in the first range. That is, when the electric charge amount changes from a value in the second range to a value in the first range at Step S7 (S7: YES), the control flow goes to Step S8. In this instance, the ink-bottle remaining-amount determining portion 5*f* ends the determination of the ink remaining amount in the ink bottle 70. As the ink remaining amount in the ink bottle 70, the ink remaining amount at a time point when the ink bottle 70 is detached from the ink tank 18 is stored in the storage 5*c*, and this ink remaining amount is displayed on the display portion 1*a*. On the other hand, in the case where the ink bottle 70 remains attached to the ink tank 18, the electric charge amount detected by the electric-charge-amount detecting portion 5*e* falls within the second range. That is, when the electric charge amount falls within the second range at Step S7 (S7: NO), the control flow returns to Step S5. In this way, the ink remaining amount in the ink bottle 70 is determined at suitable timing and stored in the storage 5*c* until the ink bottle 70 is detached from the ink tank 18.

At Step S8, the controller 5 determines whether a reset button (not shown) is pushed by the user. When the reset button is pushed (S8: YES), the control flow goes to Step S9. On the other hand, when the reset button is not pushed (S8: NO), Step S8 is repeated. The user pushes the reset button after the ink tank 18 is refilled with the ink such that the ink tank 18 becomes full. In the case where the ink tank 18 does not become full by the ink in the single ink bottle 70, a plurality of ink bottles 70 are used to refill the ink tank 18 such that the ink tank 18 becomes full.

At Step S9, the notification control portion 5*h* controls the display portion 1*a* to display the ink remaining amount in the ink tank 18 (here, full amount). Further, the notification control portion 5*h* determines the recordable number of sheets based on the ink remaining amount in the ink tank 18 and the ink remaining amount in the ink bottle 70 stored in the storage 5*c*, so as to display the recordable number of sheets on the display portion 1*a*. Thus, the first control flow is ended.

The second control flow will now be explained with reference to FIG. 11. The second control flow is executed concurrently when Step S4 of the first control flow is executed. That is, when the electric charge amount changes from a value in the first range to a value in the second range at Step F1 (F1: YES) as in Step S4, the control flow goes to Step F2. On the other hand, when the electric charge amount falls within the first range at Step F1 (F1: NO), Step F1 is repeated.

At Step F2, the determining portion 5*g* determines whether the ink remaining amount in the ink bottle 70 has decreased to such an extent that the ink is about to overflow the ink tank 18. When it is determined that the ink remaining amount in the ink bottle 70 has decreased to the extent to cause the overflow of the ink from the ink tank 18 (F2: YES), the control flow goes to Step F3. On the other hand, when it is determined that the ink remaining amount in the ink bottle 70 is not yet decreased to the extent to cause the ink overflow (F2: NO), Step F2 is repeated. The determination at Step F2 may be made as follows, for instance. A value, as a reference value, to be compared with a decrease amount of the ink remaining amount in the ink bottle 70 may be set in advance, and the control flow may go to Step F3 when the decrease amount of the ink remaining amount in the ink bottle 70 becomes greater than or equal to the reference value. The reference value may be a value smaller, by 10%, for instance, than a difference between the capacity of the ink tank 18 and the ink remaining amount in the ink tank 18 at a time point when the ink supply from the ink bottle 70 is started. Further, the decrease amount of the ink remaining amount in the ink bottle 70 at Step F2 may be a decrease amount in a time period from a first time point when it is determined at Step F1 that the ink bottle 70 is attached to the ink tank 18 to a second time point when a predetermined time (e.g., one minute) elapses after the first time point.

At Step F3, the notification control portion 5*h* controls the display portion 1*a* to display a warning message notifying the user that the ink is about to overflow the ink tank 18. Further, the notification control portion 5*h* controls the buzzer 1*c* to generate a warning sound notifying the user that the ink overflow is about to occur (warning process).

At Step F4, the controller 5 determines whether the ink bottle 70 is detached from the ink tank 18, as in Step S7. That is, when the electric charge amount changes from a value in the second range to a value in the first range at Step F4 (F4: YES), the controller 5 ends the second control flow. On the other hand, when the electric charge amount falls within the second range at Step F4 (F4: NO), the control flow returns to Step F3. In this way, the information indicating that the ink overflow will occur (i.e., the warning message and the warning sound) is notified to the user until the ink bottle 70 is detached from the ink tank 18.

According to the MFP 1 of the present embodiment explained above, the information relating to the ink remaining amount in the ink bottle 70 can be notified to the user at Step S6. In this configuration, the user can recognize that the ink in the ink bottle 70 has run out or is about to run out, for instance. It is thus possible for the user to prepare a new ink bottle 70.

By executing Step F3, it is possible to notify the user that the ink is about to overflow the ink tank 18 when the ink is poured from the ink bottle 70 into the ink tank 18. In this configuration, the ink is prevented from overflowing the ink tank 18.

The ink remaining amount in the ink bottle 70 is displayed on the display portion 1*a* at Step S6, so that the user can easily notice the information relating to the ink remaining amount in the ink bottle 70.

The recordable number of sheets is displayed on the display portion 1*a* at Step S2 and Step S9. It is thus possible to notify the user of the number of sheets P on which image recording can be performed with use of a total amount of the ink in the ink tank 18 and the ink bottle 70.

The ink bottle 70 is provided with the pair of electrodes 72, and the controller 5 includes the electric-charge-amount detecting portion 5*e*. Thus, it is possible to detect, with a simple configuration, the electric charge amount for determining the ink remaining amount in the ink bottle 70.

The ink-bottle remaining-amount determining portion 5*f* starts, at Step S5, the determination of the ink remaining amount in the ink bottle 70, in response to a change of the electric charge amount detected by the electric-charge-amount detecting portion 5*e* from a value in the first range to a value in the second range. This configuration enables the ink remaining amount in the ink bottle 70 to be determined by attaching the ink bottle 70 to the ink tank 18.

The pair of electrodes 72 extend along the ink flow direction, enabling the ink remaining amount in the ink bottle 70 to be accurately detected. Further, the positioning mark 18*b*2 and the positioning mark 71*b*2 are formed on the ink tank 18 and the ink bottle 70, respectively. This configuration enables accurate determination of the ink remaining amount in the ink bottle 70 by lining up the positioning marks formed on the ink bottle 70 and the ink tank 18 even when the ink flow direction is inclined with respect to the up-down direction A1 in a state in which the ink bottle 70 is attached to the ink tank 18.

In the illustrated embodiment, the determination of the ink remaining amount in the ink bottle 70 is started at Step S5 in response to a change of the electric charge amount detected by the electric-charge-amount detecting portion 5*e* from a value in the first range to a value in the second range. As a modification, the ink tank 18 may be provided with a special detecting sensor (as one example of a liquid-bottle detecting sensor) 80 configured to detect that the ink bottle 70 is attached to the ink tank 18, as indicated by the long dashed double-short dashed line in FIG. 4. The detecting sensor 80 in this modification is configured to come into contact with the ink bottle 70 when the ink bottle 70 is attached to the ink tank 18 and output, to the controller 5, a detection signal indicative of the attachment of the ink bottle 70 to the ink tank 18. The ink-bottle remaining-amount determining portion 5*f* may start, at Step S5, the determination of the ink remaining amount in the ink bottle 70 based on the detection signal output from the detecting sensor 80. Thus, the ink remaining amount in the ink bottle 70 can be determined by attaching the ink bottle 70 to the ink tank 18.

While the first embodiment has been described above, it is to be understood that the disclosure is not limited to the details of the illustrated first embodiment, but may be embodied with other various changes which may occur to those skilled in the art, without departing from the scope of the disclosure defined in the attached claims. For instance, the storage 5*c* does not necessarily have to store the capacity and the ink remaining amount of the ink tank 18. That is, the controller 5 does not necessarily have to include the ink-tank remaining-amount estimating portion 5*d* and the determining portion 5*g*. Also in this configuration, it is possible to determine the ink remaining amount in the ink bottle 70, store the determined ink remaining amount in the storage 5*c*, and to notify the user of the ink remaining amount in the ink bottle 70. Thus, this configuration offers advantages similar to those in the illustrated embodiment.

Only one of the display portion 1*a* and the buzzer 1*c*, each as the notifying device, may be provided. Based on the ink remaining amount in the ink bottle 70 stored in the storage 5*c*, the notification control portion 5*h* may control at least one of the display portion 1*a* and the buzzer 1*c* to notify the user that the ink remaining amount in the ink bottle 70 is close to zero (empty), namely, the ink bottle 70 is near empty, at a time point immediately before the ink bottle 70 becomes empty. This notification may be repeatedly performed every time the printing operation is performed. The ink bottle 70 may be provided with a grounded metal foil in the vicinity of the pair of electrodes 72 to shield the electrodes 72. This configuration enables accurate detection of the electric charge amount between the electrodes 72.

The number of recordable sheets does not necessarily have to be displayed on the display portion 1*a*. The ink remaining amount in the ink bottle 70 may be detected by a remaining-amount detecting sensor other than the pair of electrodes 72, such as an optical sensor or a float-type level meter for detecting the liquid level of the ink. In the case where there is employed a remaining-amount detecting sensor (such as an optical sensor) capable of detecting, from outside, the ink remaining amount in the ink bottle 70 attached to the ink tank 18, such a remaining-amount detecting sensor may be provided for the MFP 1. The positioning marks 18*b*2, 71*b*2 may be omitted.

A plurality of ink tanks 18 may be provided in the MFP 1 of the illustrated embodiment. The plurality of ink tanks 18 may respectively store inks of mutually different colors or may store ink of the same color. In this case, the MFP 1 may include the ink bottles 70 storing inks whose colors correspond to colors of the inks stored in the respective ink tanks 18 or the MFP 1 may include the ink bottles 70 storing ink whose color corresponds to the color of the ink stored in the plurality of ink tanks 18. Also in this configuration, the ink remaining amount is determined for each ink bottle 70 in the same manner as described above, and the ink remaining amount determined for each ink bottle 70 is notified to the user by the notifying device, so that the same advantages as described above are offered.

At Step S1, the ink-tank remaining-amount estimating portion 5*d* may calculate the count value by adding an ink consumption amount associated with flushing for recovering or restoring ink meniscus in the ejection openings 41*a* of the recording head 41, to the ink consumption amount when the image recording is performed on the sheet P and the ink consumption amount when the ink discharging operation for maintenance is performed, and may estimate the ink remaining amount in the ink tank 18. The ink-tank remaining-amount estimating portion 5*d* may calculate the count value of one or two of the ink consumption amount when the image recording is performed on the sheet P, the ink consumption amount when the ink discharging operation for maintenance is performed, and the ink consumption amount when the flushing is performed, and may estimate the ink remaining amount in the ink tank 18. The ink-tank remaining-amount estimating portion 5*d* may be omitted. In this case, the user may visually check the ink remaining amount in the ink tank and may suitably refill the ink tank 18 with the ink in the ink bottle 70. The present disclosure is applicable to liquid ejecting apparatus configured to eject a liquid other than the ink.

Figure 12:
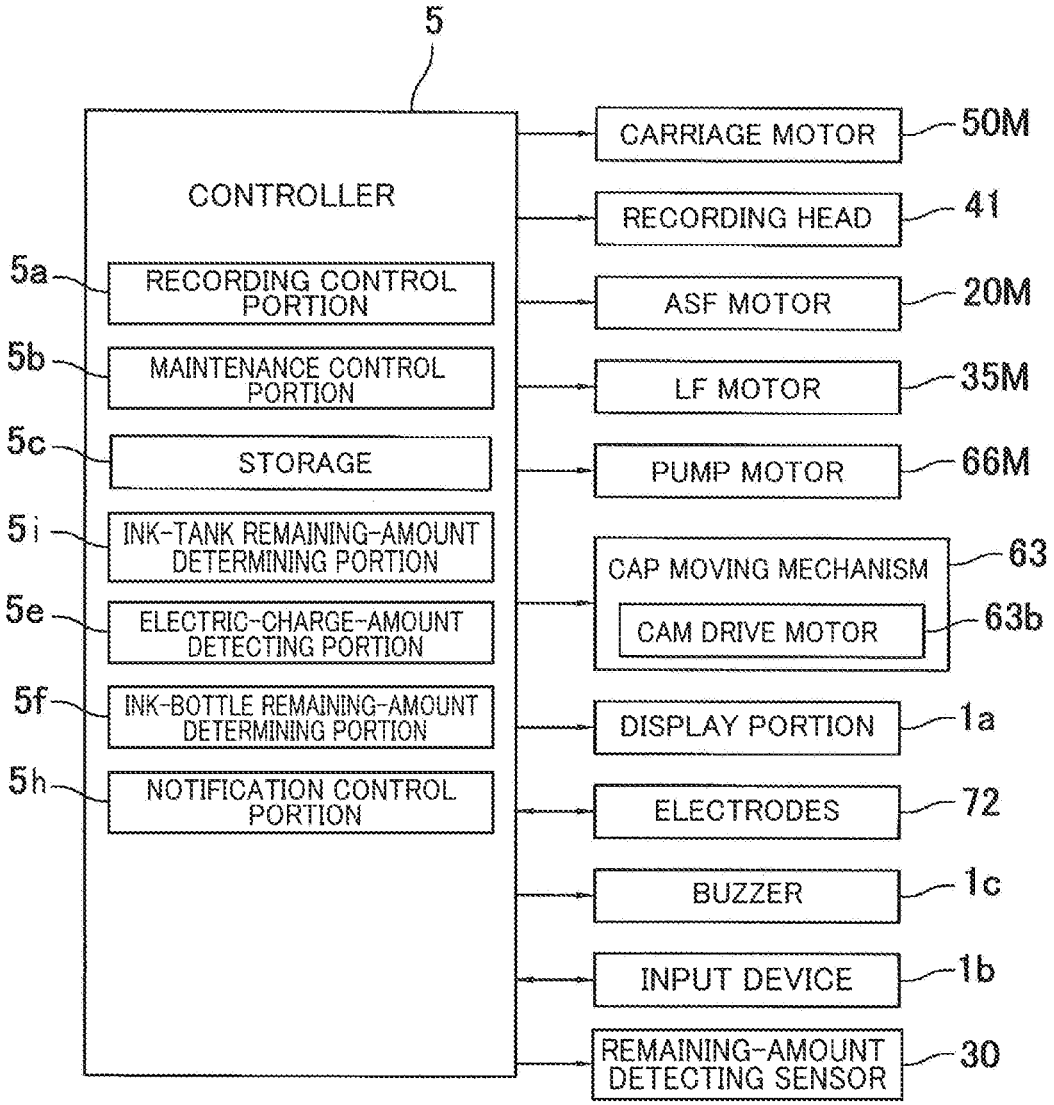
FIG. 12 is a block diagram of a controller of an MFP according to a second embodiment.
Figure 13:
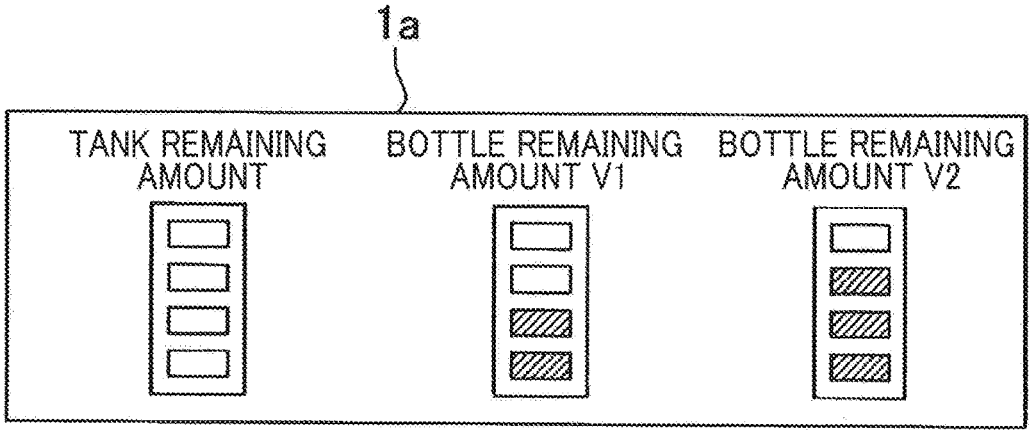
FIG. 13 is a schematic view of a display portion of the MFP according to the second embodiment.

There will be now explained a multi-functional peripheral (MFP) 1, as one example of a liquid ejecting apparatus, according to a second embodiment of the present disclosure. In the second embodiment, the same reference numerals as used in the illustrated first embodiment are used to identify the corresponding components, and its detailed explanation is dispensed with. FIG. 12 is a block diagram of the controller 5 according to the second embodiment. In the second embodiment, based on the tank remaining amount in the ink tank 18 and the bottle remaining amount in the ink bottle 70 stored in the storage 5*c*, the notification control portion 5*h* controls the display portion 1*a* to display the tank remaining amount and the bottle remaining amount, as shown in FIG. 13. In the second embodiment, as shown in FIG. 13, the tank remaining amount and the bottle remaining amount are indicated by four levels. The tank remaining amount and the bottle remaining amount may be indicated in any manner as long as the remaining amounts can be notified to the user. In FIG. 13, a tank remaining amount is in a near empty state, a bottle remaining amount V1 is half, and a bottle remaining amount V2 is ¾. In the second embodiment, the bottle remaining amounts V1, V2 of the respective two ink bottles 70 are storable. The bottle remaining amount of one ink bottle 70 or the bottle remaining amounts of three or more ink bottles 70 may be storable.

The ink bottle 70 for refilling the ink tank 18 with the ink is removably installed on the MFP 1 of the second embodiment. As shown in FIGS. 4 and 5, the ink bottle 70 includes the bottle body 71 having the ink chamber 71*a* storing the ink therein. A capacity of the ink bottle 70 is larger than a capacity of the ink tank 18 (maximum capacity). That is, the ink bottle 70 in a brand-new condition stores the ink whose amount is larger than the capacity of the ink tank 18. While the capacity of the ink bottle 70 is about 1.5 times as large as the capacity of the ink tank 18 in the present embodiment, the capacity of the ink bottle 70 is not limited to particular values.

The ink tank 18 of the second embodiment is provided with a remaining-amount detecting sensor 30 (FIG. 12). The remaining-amount detecting sensor (as one example of a tank remaining-amount output device) 30 is a known float-type sensor and configured to detect a tank remaining amount which is a remaining amount of the ink stored in the ink tank 18 and output, to the controller 5, a tank remaining-amount signal for determining the tank remaining amount. The remaining-amount detecting sensor 30 may be a sensor other than the float-type sensor, such as an optical sensor, as long as the sensor is capable of detecting the tank remaining amount in the ink tank 18.

The storage 5*c* is configured to store the tank capacity of the ink tank 18, the tank remaining amount of the ink tank 18, the bottle remaining amounts of the ink bottles 70, and an ink amount indicating that the ink tank 18 is near empty, namely, an ink amount indicative of near empty, i.e., a threshold. The storage 5*c* stores the electric charge amount detected between the pair of electrodes 72 at a time when the ink bottle 70, which is full of the ink, is attached to the ink tank 18. That is, the storage 5*c* stores an ink-full electric charge amount when the ink bottle 70 is full.

On occasions such as when the MFP 1 is turned on, when printing is completed, and when the ink discharging operation such as maintenance (suction purging) is completed, the ink-tank remaining-amount determining portion 5*i* determines the tank remaining amount based on the tank remaining-amount signal output from the remaining-amount detecting sensor 30 and stores the determined tank remaining amount in the storage 5*c*.

The electric-charge-amount detecting portion (as one example of a receiving device) 5*e* is constituted by the connection terminals 18*c*, an electric charge amount detection circuit connected to the connection terminals 18*c* for detecting the electric charge amount, an A/D conversion circuit, and wires connecting the connection terminals 18*c* and the circuits. The electric-charge-amount detecting portion 5*e* always outputs a predetermined voltage in a state in which the MFP 1 is turned on, such that the predetermined voltage can be applied to the pair of electrodes 72 when the ink bottle 70 is attached to the ink tank 18 by the user. In this configuration, the electric-charge-amount detecting portion 5*e* is capable of detecting the electric charge amount accumulated between the pair of electrodes 72 and detects the electric charge amount in the second range described above. That is, the electric-charge-amount detecting portion 5*e* functions as a receiving device configured to receive the electric charge amount as a bottle remaining-amount signal for determining the bottle remaining amount which is the ink remaining amount in the ink bottle 70 attached to the inlet portion 18*b*. In a state in which the ink bottle 70 is not attached to the ink tank 18, the electric-charge-amount detecting portion 5*e* is capable of detecting the electric charge amount to the connection terminals 18*c* and detects the electric charge amount in the first range described above.

The notification control portion 5*h* controls the display portion 1*a* to notify the user of a message that the ink can be poured from the ink bottle 70 when a refillable amount obtained by subtracting the tank remaining amount from the tank capacity reaches the stored bottle remaining amount. In this instance, the notification control portion 5*h* blinks one of the two bottle remaining amounts V1, V2 that corresponds to one of the pourable ink bottles 70 from which the ink can be poured. Further, the notification control portion 5*b* controls the buzzer 1*c* to generate a sound indicating that the ink can be poured from the ink bottle 70.

When the tank remaining amount reaches the ink amount indicative of near empty, the notification control portion 5*h* controls the display portion 1*a* to notify the user of a message that the tank remaining amount is becoming close to zero (empty), namely, the ink tank 18 is near empty. In this instance, the notification control portion 5*h* controls the buzzer 1*c* to generate a sound indicating that the ink tank 18 is near empty.

When the user pours the ink in a state in which the refillable amount obtained by subtracting the tank remaining amount from the ink the tank capacity does not yet reach the stored bottle remaining amount, the notification control portion 5*h* controls the display portion 1*a* to display a warning message warning the user that the refillable amount does not yet reach the stored bottle remaining amount. In this instance, the notification control portion 5*h* controls the display portion 1*a* to blink the warning message and to shorten the blinking interval in accordance with a decrease in the bottle remaining amount. Further, the notification control portion 5*h* controls the buzzer 1*c* to generate a warning sound warning the user that the refillable amount does not yet reach the stored bottle remaining amount. Further, the notification control portion 5*h* controls the buzzer 1*c* to increase the volume of the warning sound in accordance with a decrease in the bottle remaining amount.

In the case where the bottle remaining amount in the ink bottle 70 currently attached to the ink tank 18 differs from the bottle remaining amount stored in the storage 5*c*, the notification control portion 5*h* controls the display portion 1*a* to display a message that prompts the user to stop pouring the ink from the ink bottle 70 before the bottle remaining amount in the ink bottle 70 currently attached to the ink tank 18 reaches the bottle remaining amount stored in the storage 5*c*. Further, the notification control portion 5*h* controls the buzzer 1*c* to generate a sound that prompts the user to stop pouring the ink from the ink bottle 70.

In the second embodiment, the notification control portion 5*h* controls the display portion 1*a* to display the ink remaining amounts of the ink tank 18 and the ink bottles 70 and various messages. Alternatively, the notification control portion 5*h* may control an external apparatus (as one example of a notifying device) such as a wiredly or wirelessly connected PC to display the ink remaining amounts of the ink tank 18 and the ink bottles 70 and various messages.

Figure 14A:
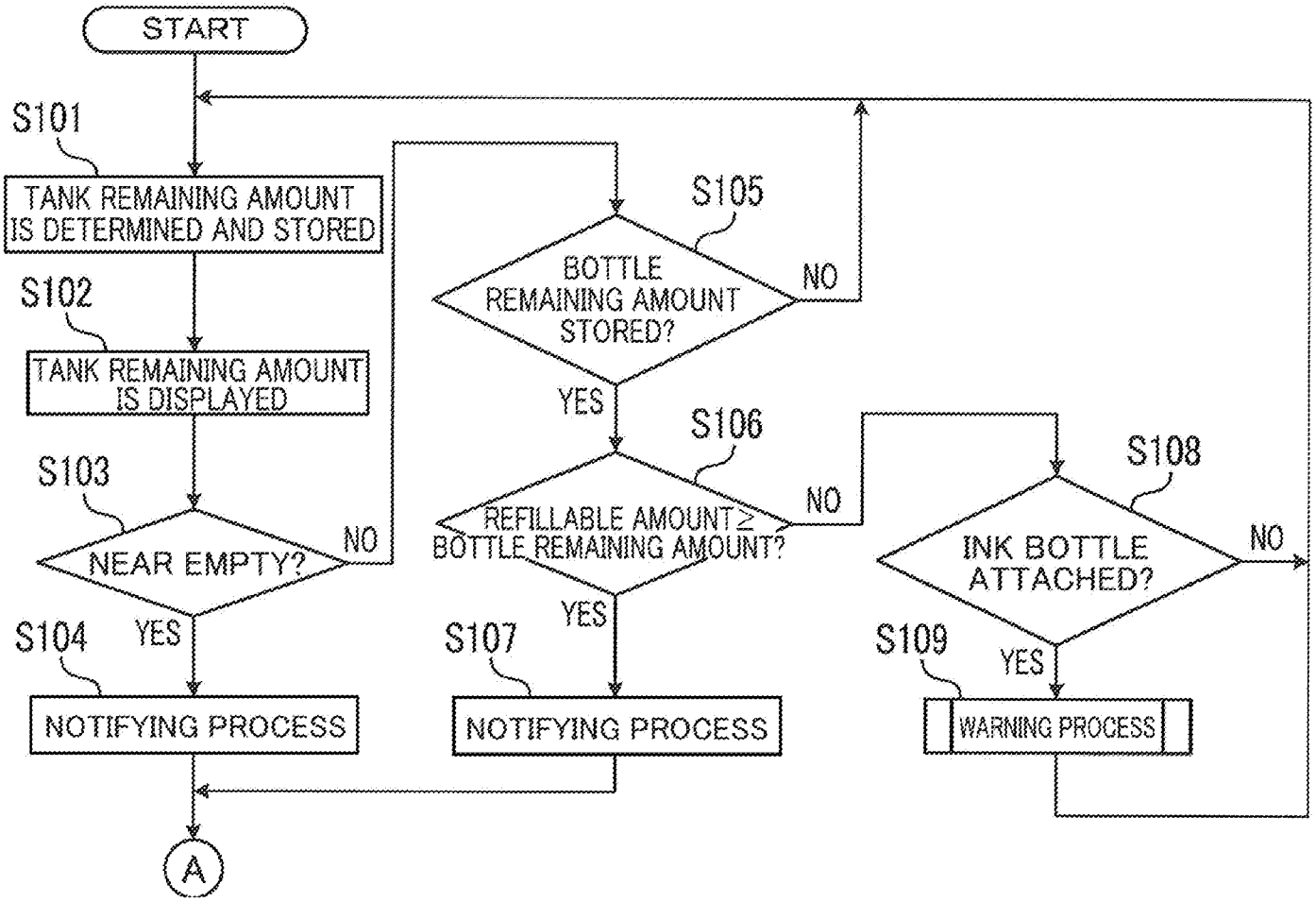
FIG. 14A is a view showing a part of a first control flow of the MFP according to the second embodiment.
Figure 14B:
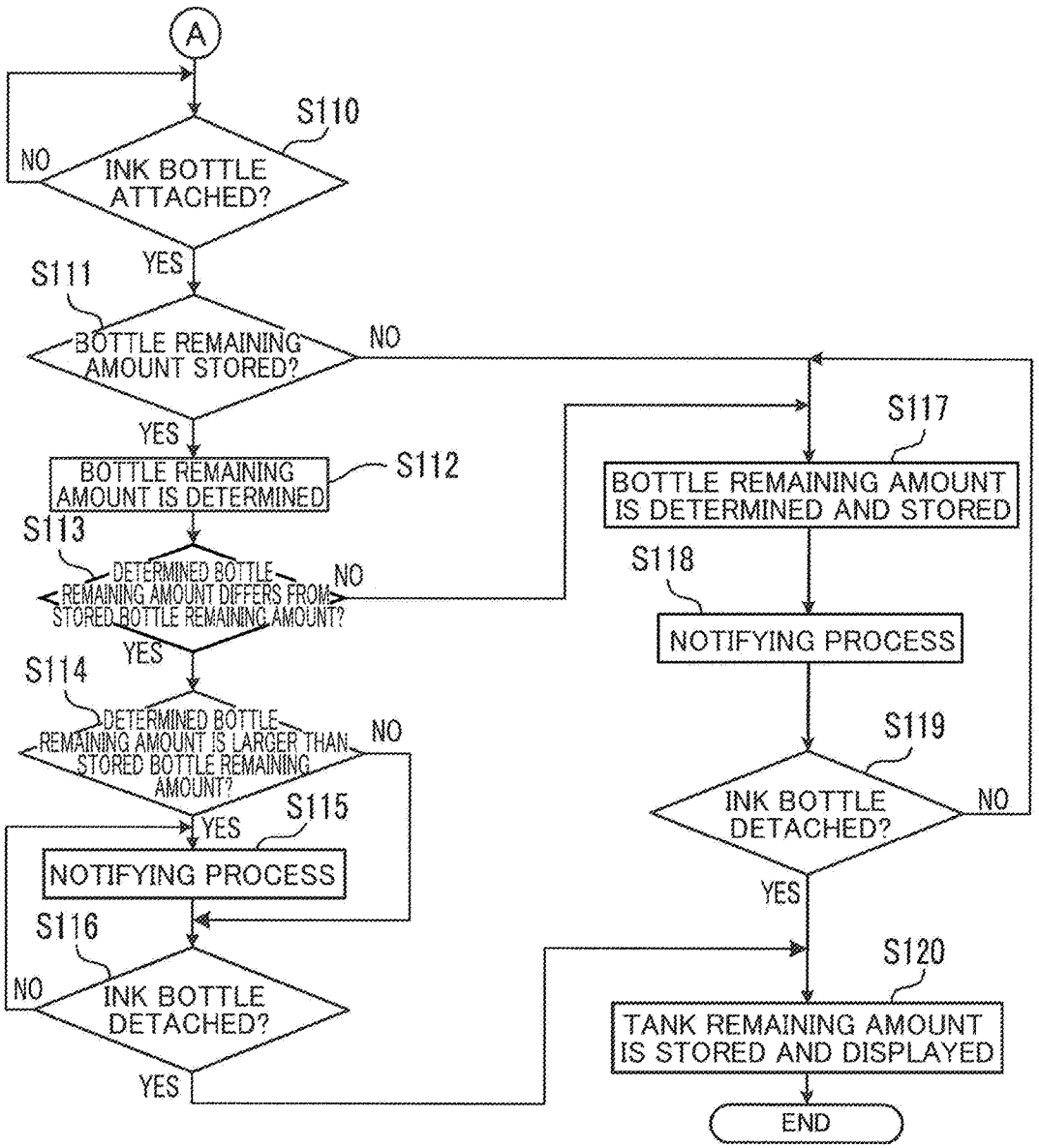
FIG. 14B is a view showing another part of the first control flow of the MFP according to the second embodiment.
Figure 15:
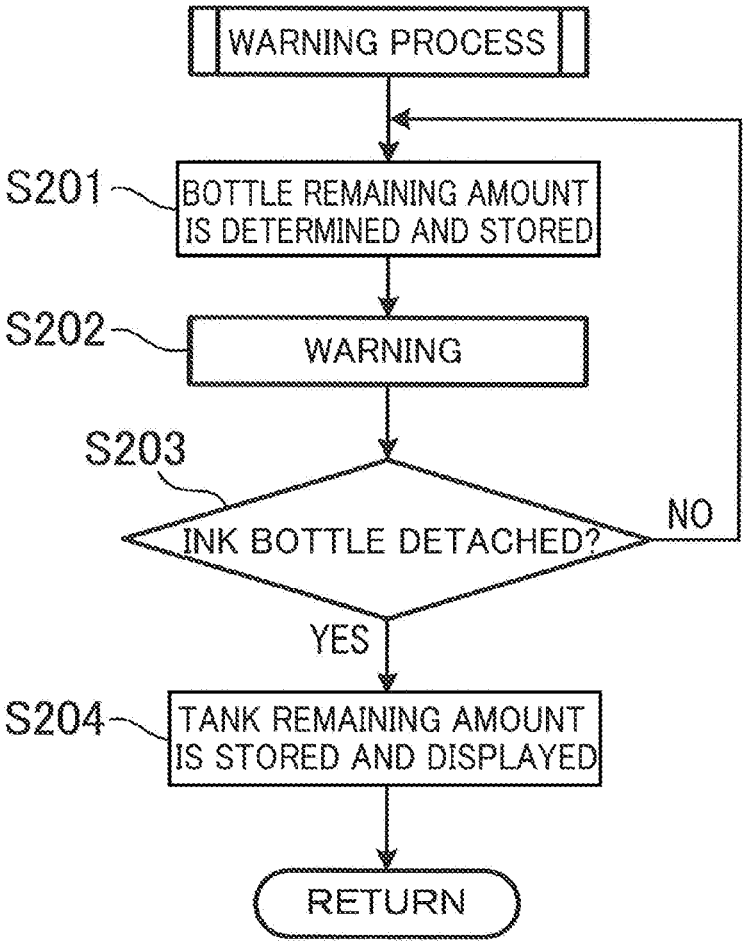
FIG. 15 is a view showing a control flow of a warning process in FIG. 14.
Figure 16:
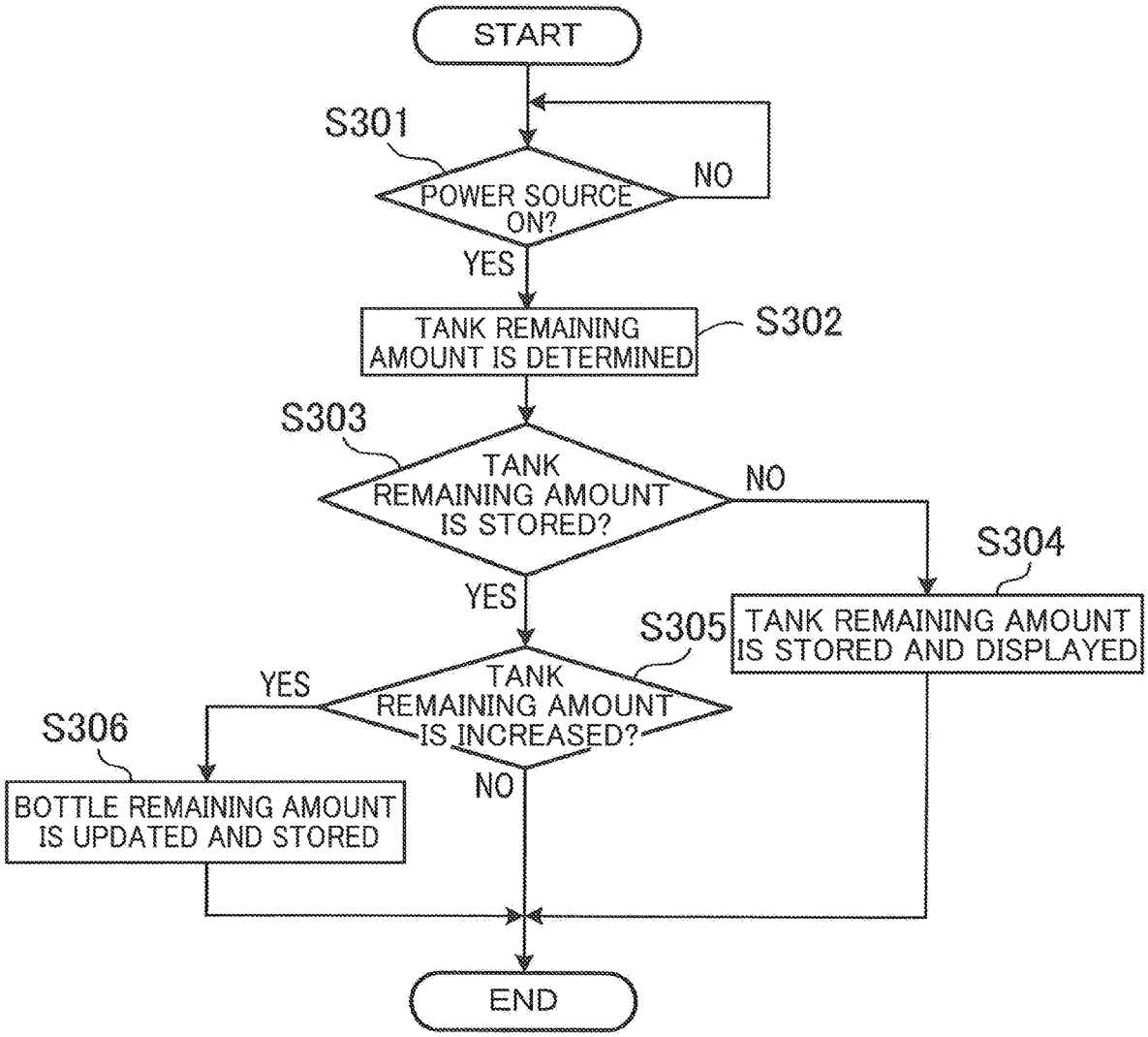
FIG. 16 is a view showing a second control flow of the MFP according to the second embodiment.

Referring next to FIGS. 14-16, a first control flow and a second control flow of the MFP 1 according to the second embodiment will be explained. The first control flow is mainly for determining the tank remaining amount in the ink tank 18 and determining the bottle remaining amount in the ink bottle 70 attached to the ink tank 18. The second control flow is a flow in the case where the ink tank 18 is refilled with the ink during turn-off of the MFP 1. The first control flow will be initially explained.

As shown in FIG. 14, at S101 of the first control flow, the ink-tank remaining-amount determining portion 5*i* determines the tank remaining amount based on the tank remaining-amount signal output from the remaining-amount detecting sensor 30, and stores the tank remaining amount in the storage 5*c* (tank remaining amount determining process) when printing for image recording on the sheet P is completed and when the ink discharging operation such as maintenance is completed.

At S102, based on the tank remaining amount stored in the storage 5*c*, the notification control portion 5*h* controls the display portion 1*a* to display the tank remaining amount.

At S103, the controller 5 determines whether the tank remaining amount determined and stored by the ink-tank remaining-amount determining portion 5*i* has reached the ink amount indicative of near empty. When it is determined that the tank remaining amount has reached the ink amount indicative of near empty (S103: YES), the control flow goes to S104. On the other hand, when it is determined that the tank remaining amount does not yet reach the ink amount indicative of near empty (S103: NO), the control flow goes to S105. At S104, the notification control portion 5*h* controls the buzzer 1*c* and the display portion 1*a* to notify the user a message and a sound (as one example of tank remaining-amount notification) indicating that the tank remaining amount is becoming close to zero (empty), namely, the ink tank 18 is near empty (second notifying process).

At S105, the controller 5 determines whether the bottle remaining amount is stored in the storage 5*c*. When it is determined that the bottle remaining amount is stored in the storage 5*c* (S105: YES), the control flow goes to S106. On the other hand, when it is determined that the bottle remaining amount is not stored in the storage 5*c* (S105: NO), the control flow returns to S101. The situation in which the control flow returns to S101 means that no partially used ink bottle 70 is kept.

There will be now explained a flow when ink refilling is performed in the case where the control flow goes from S104 or S107 to S110. The user attaches the ink bottle 70 to the ink tank 18 based on information at S104 and at S107 (which will be explained). In this instance, the controller 5 determines at S110 whether the ink bottle 70 is attached to the ink tank 18. In the case where the user refills the ink tank 18 with the ink, the user attaches the ink bottle 70 to the ink tank 18 with the positioning marks 18*b*2, 71*b*2 lined up as shown in FIG. 4. As a result, the connection terminals 18*c* and the pair of electrodes 72 are brought into electrical connection with each other, so that the electric charge amount detected by the electric-charge-amount detecting portion 5*e* changes from a value in the first range to a value in the second range. When the electric charge amount changes from a value in the first range to a value in the second range at S110 (S110: YES), the control flow goes to S111. On the other hand, in the case where the ink bottle 70 is not attached to the ink tank 18, the electric charge amount detected by the electric-charge-amount detecting portion 5*e* falls within the first range. That is, when the electric charge amount falls within the first range at S110 (S110: NO), S110 is repeated.

At S111, the controller 5 determines, as in S105, whether the bottle remaining amount is stored in the storage 5*c*. In the case where a partially used ink bottle 70 exists and the bottle remaining amount is stored (S111: YES), the control flow goes to S112. On the other hand, in the case where no partially used ink bottle 70 exists and the bottle remaining amount is not stored (S111: NO), the control flow goes to S117.

When the control flow goes from S111 to S117, the ink-bottle remaining-amount determining portion 5*f* starts the determination of the bottle remaining amount in the ink bottle 70 in response to a change of the electric charge amount detected by the electric-charge-amount detecting portion 5*e* from a value in the first range to a value in the second range. The ink-bottle remaining-amount determining portion 5*f* determines the bottle remaining amount as explained above (bottle remaining amount determining process) and stores the determined bottle remaining amount in the storage 5*c* (bottle remaining amount storing process). The bottle remaining amount stored at this time corresponds to the bottle remaining amount V1.

At S118, based on the bottle remaining amount stored in the storage 5*c*, the notification control portion 5*h* controls the display portion 1*a* to display the bottle remaining amount. The bottle remaining amount displayed at this time corresponds to the bottle remaining amount V1. Further, the notification control portion 5*h* controls at S118 the buzzer 1*c* such that the sound volume increases as the tank remaining amount of the ink tank 18 becomes close to the full amount. In this way, it is possible to notify the user that the tank remaining amount of the ink tank 18 is becoming close to the full amount and to thereby prevent the ink from overflowing the ink tank 18. The notification at S118 for preventing the ink overflow may be made such that the notification control portion 5*h* controls the display portion 1*a* to notify to the user. The manner of the notification is not limited to particular one.

At S119, the controller 5 determines whether the ink bottle 70 is detached from the ink tank 18. In the case where the user detaches the ink bottle 70 from the ink tank 18 based on the information displayed by the display portion 1*a* at S118, the electrical connection between the connection terminals 18*c* and the electrodes 72 is canceled, so that the electric charge amount detected by the electric-charge-amount detecting portion 5*e* changes from a value in the second range to a value in the first range. In the case where the electric charge amount falls within the second range at S119 (S119: NO), the control flow returns to S117. This means that the ink refilling from the ink bottle 70 is continued.

When the electric charge amount changes from a value in the second range to a value in the first range at S119 (S119: YES), the control flow goes to S120. This means that the ink refilling is completed and that the ink bottle 70 is detached from the ink tank 18 by the user. At this time, the ink-bottle remaining-amount determining portion 5*f* ends the determination of the ink remaining amount in the ink bottle 70. As the bottle remaining amount in the ink bottle 70, the bottle remaining amount at a time point when the ink bottle 70 is detached from the ink tank 18 is stored in the storage 5*c* (bottle remaining amount storing process), and this bottle remaining amount V1 is displayed on the display portion 1*a*.

When the control flow goes from S111 to S112, the ink-bottle remaining-amount determining portion 5*f* starts, as in S117, the determination of the bottle remaining amount in the ink bottle 70 (bottle remaining-amount determining process).

At S113, the controller 5 determines whether the bottle remaining amount determined at S112 differs from the bottle remaining amount V1 stored in the storage 5*c*. When the bottle remaining amounts differ from each other at S113 (S113: YES), the control flow goes to S114. On the other hand, when the bottle remaining amounts are the same (S113: NO), the control flow goes to S117.

At S114, the controller 5 determines whether the bottle remaining amount determined at S112 is larger than the bottle remaining amount V1 stored in the storage 5*c*. When the bottle remaining amount determined at S112 is smaller than the bottle remaining amount V1 (S114: NO), the control flow goes to S116. On the other hand, when the bottle remaining amount determined at S112 is larger than the bottle remaining amount V1 (S114: YES), the control flow goes to S115. The situation in which the control flow goes to S115 means that the user opens a brand-new ink bottle 70 and attaches the brand-new ink bottle 70 to the ink tank 18 even though the ink bottle 70 that has been partially used is present, for instance.

At S115, the notification control portion 5*h* controls the display portion 1*a* to display a message to prompt the user to stop pouring the ink from the ink bottle 70 before the bottle remaining amount in the ink bottle 70 currently attached to the ink tank 18 reaches the bottle remaining amount V1 stored in the storage 5*c*. In this instance, the notification control portion 5*h* controls the buzzer 1*c* to generate a sound that prompts the user to stop pouring the ink from the ink bottle 70. The notifying process at S115 is executed for the following reasons. That is, if the ink tank 18 is refilled using the ink in a brand-new ink bottle 70 after the notifying process at S107, there is a possibility that the ink overflows the ink tank 18. Accordingly, the notification to prompt the user to stop pouring the ink is given to the user (stop-of-pouring notifying process).

At S116, the controller 5 determines whether the ink bottle 70 is detached from the ink tank 18. When the user detaches the ink bottle 70 from the ink tank 18 based on the information by the message and the sound at S115, the electric charge amount detected by the electric-charge-amount detecting portion 5*e* changes from a value in the second range to a value in the first range. That is, when the electric charge amount changes from a value in the second range to a value in the first range at S116 (S116: YES), the control flow goes to S120. In this instance, the ink-bottle remaining-amount determining portion 5*f* ends the determination of the ink remaining amount in the ink bottle 70. As the bottle remaining amount in the ink bottle 70, the bottle remaining amount at a time point when the ink bottle 70 is detached from the ink tank 18 is stored in the storage 5*c* (bottle remaining amount storing process), and this bottle remaining amount is displayed on the display portion 1*a*. This bottle remaining amount is stored separately from the bottle remaining amount V1 stored in advance in the storage 5*c*. That is, this bottle remaining amount corresponds to the bottle remaining amount V2. As shown in FIG. 9, the bottle remaining amount V2 is displayed on the display portion 1*a* together with the bottle remaining amount V1. On the other hand, when the electric charge amount falls within the second range at S116 (S116: NO), the control flow returns to S115. That is, the notifying process at S115 is repeatedly executed.

At S120, the ink-tank remaining-amount determining portion 5*i* determines the tank remaining amount based on the tank remaining-amount signal output from the remaining-amount detecting sensor 30 and stores the determined tank remaining amount in the storage 5*c*, as in S101. Subsequently, the notification control portion 5*h* controls the display portion 1*a* to display the tank remaining amount in the ink tank 18.

When the control flow goes to S106 from S105, the controller 5 determines whether a refillable amount (an amount of the ink that can be added to the ink tank 18) has reached the bottle remaining amount V1. The refillable amount is obtained by subtracting the stored tank remaining amount from the tank capacity. When it is determined at S106 that the refillable amount has reached the bottle remaining amount V1 (S106: YES), the control flow goes to S107. On the other hand, when it is determined that the refillable amount does not yet reach the bottle remaining amount V1 (S106: NO), the control flow goes to S108. At S107, the notification control portion 5*h* controls the buzzer 1*c* and the display portion 1*a* to give the user a notification (first notifying process) that includes a message indicating that the ink can be poured from the ink bottle 70, blinking of the indicator of the bottle remaining amount V1 corresponding to the ink bottle 70 from which the ink is pourable, and a sound (as one example of remaining amount pouring notification). In the case where the two bottle remaining amounts V1, V2 are being displayed, blinking of the indicator of the bottle remaining amount V1 enables the user to easily recognize the pourable ink bottle 70. The control flow goes from S107 to S110 explained above and finally goes to S120.

At S108, the controller 5 determines whether the ink bottle 70 is attached to the ink tank 18. When the electric charge amount changes from a value in the first range to a value in the second range at S108 (S108: YES), the control flow goes to S109. On the other hand, when the electric charge amount falls within the first range at S108 (S108: NO), the control flow returns to S101. At S109, the controller 5 executes a warning process, and the controls flow then returns to S101.

Referring next to FIG. 15, the warning process will be explained. As shown in FIG. 15, the warning process starts with S201 at which the ink-bottle remaining-amount determining portion 5*f* stars the determination of the bottle remaining amount in the ink bottle 70 in response to a change in the electric charge amount detected by the electric-charge-amount detecting portion 5*e* from a value in the first range to a value in the second range. The ink-bottle remaining-amount determining portion 5*f* determines the bottle remaining amount as described above (bottle remaining amount determining process) and stores the determined bottle remaining amount in the storage 5*c* (bottle remaining amount storing process).

At S202, the notification control portion 5*h* controls the display portion 1*a* to give the user a warning message and a warning sound indicating that the refillable amount does not yet reach the bottle remaining amount. The notification is given to the user for the following reasons. In this situation, because the user pours the ink in a state in which the refillable amount, which is obtained by subtracting the tank remaining amount from the tank capacity, does not yet reach the stored bottle remaining amount, there is a possibility that the poured ink will overflow the ink tank 18.

At S203, the controller 5 determines whether the ink bottle 70 is detached from the ink tank 18. In the case where the user detaches the ink bottle 70 from the ink tank 18 prompted by the warning message and the warning sound, the electric charge amount detected by the electric-charge-amount detecting portion 5*e* changes from a value in the second range to a value in the first range. When the electric charge amount changes from a value in the second range to a value in the first range at S203 (S203: YES), the control flow goes to S204. In this instance, the ink-bottle remaining-amount determining portion 5*f* ends the determination of the ink remaining amount in the ink bottle 70. As the bottle remaining amount in the ink bottle 70, the bottle remaining amount at a time point when the ink bottle 70 is detached from the ink tank 18 is stored in the storage 5*c* (bottle remaining amount storing process), and this bottle remaining amount V1 is displayed on the display portion 1*a*.

On the other hand, in the case where the ink bottle 70 is kept attached to the ink tank 18, the electric charge amount detected by the electric-charge-amount detecting portion 5*e* falls within the second range. That is, when the electric charge amount falls within the second range at S203 (S203: NO), the control flow returns to Step S201. In this way, the ink remaining amount in the ink bottle 70 is determined and stored in the storage 5*c* at S201 at suitable timing until the ink bottle 70 is detached from the ink tank 18.

In the case where Step S202 is repeatedly executed, namely, in the case where the ink refilling to the ink tank 18 is continued without the ink bottle 70 being detached from the ink tank 18, the notification control portion 5*h* controls the display portion 1*a* to blink the warning message and to shorten the blinking interval in accordance with a decrease in the bottle remaining amount. Further, the notification control portion 5*h* controls the buzzer 1*c* to increase the volume of the warning sound in accordance with a decrease in the bottle remaining amount (warning process).

When the control flow goes from S203 to S204, the ink-tank remaining-amount determining portion 5*i* determines the tank remaining amount based on the tank remaining-amount signal output from the remaining-amount detecting sensor 30 and stores the tank remaining amount in the storage 5*c*, as in S101. Subsequently, the notification control portion 5*h* controls the display portion 1*a* to display the tank remaining amount in the ink tank 18, and the warning process is ended. Thus, the first control flow is ended by execution of S101-S120 described above.

Referring next to FIG. 16, the second control flow will be explained. As shown in FIG. 16, when the MFP 1 is turned on, namely, when the state of the power source is switched from OFF to ON, at S301 (S301: YES), the control flow goes to S302. Step S301 is repeated during a period in which the state of the power source is not ON (S301: NO).

At S302, the ink-tank remaining-amount determining portion 5*i* determines the tank remaining amount, as in S101, based on the tank remaining-amount signal output from the remaining-amount detecting sensor 30.

At S303, the controller 5 determines whether the tank remaining amount is stored in the storage 5*c*. When it is determined at S303 that the tank remaining amount is not stored (S303: NO), the control flow goes to S304. At S304, the ink-tank remaining-amount determining portion 5*i* stores, in the storage 5*c*, the tank remaining amount determined at S302. Subsequently, the notification control portion 5*h* controls the display portion 1*a* to display the tank remaining amount in the ink tank 18. Thus, the second control flow is ended.

On the other hand, when it is determined at S303 that the tank remaining amount is stored (S303: YES), the control flow goes to S305. At S305, the controller 5 determines whether the tank remaining amount determined at S302 is increased from, namely, is larger than the tank remaining amount stored in the storage 5*c*. When the determined tank remaining amount is not increased (S302: NO), the second control flow is ended. When the determined tank remaining amount is increased (S302: YES), the control flow goes to S306. In the case where the user refills the ink tank 18 with the ink during turn-off of the MFP 1, the tank remaining amount is increased. The tank remaining amount, however, remains unchanged if the user does not perform the ink refilling. That is, the tank remaining amount determined at S302 and the tank remaining amount stored in the storage 5*c* are substantially the same.

At S306, the controller 5 updates the bottle remaining amount and stores the updated bottle remaining amount in the storage 5*c* (bottle remaining-amount updating and storing process). That is, the controller 5 obtains an increased ink amount by subtracting the tank remaining amount stored in the storage 5*c* from the tank remaining amount determined at S302 and then subtracts the increased ink amount from the bottle remaining amount stored in the storage 5*c*, so as to update the bottle remaining amount. In the present embodiment, the bottle remaining amount V1 is updated and stored. Thus, the second control flow is ended.

According to the MFP 1 of the second embodiment explained above, the information relating to the bottle remaining amount V1 of the ink bottle 70 can be notified to the user at S107. That is, the bottle remaining amount V1 of the ink bottle 70 is smaller than or equal to an amount of the ink pourable into the ink tank 18, and it is accordingly possible to notify the user of the information that the entirety of the ink in the ink bottle 70 is pourable into the ink tank 18. Thus, the user need not keep a partially used ink bottle 70 unnecessarily.

When the refillable amount reaches the stored bottle remaining amount V1 at S106, S107 is executed. In this configuration, the information that the entirety of the ink in the ink bottle 70 is pourable into the ink tank 18 can be notified to the user at the earliest timing when the refillable amount (obtained by subtracting the stored tank remaining amount from the tank capacity) reaches the bottle remaining amount V1.

S104 is executed when the tank remaining amount reaches the ink amount indicative of near empty at S103. S107 is executed when the tank remaining amount does not reach the ink amount indicative of near empty at S103. In this configuration, S107 is executed before execution of S104 which is for notifying the user that the tank remaining amount is becoming close to zero (empty), namely for notifying the user of a state in which the tank remaining amount is small.

In the case where the control flow goes from S106 to S108 and then to S109, the warning process is executed. In this configuration, the user is notified that the user is pouring the ink in the ink bottle 70 in a state in which the bottle remaining amount V1 stored in the storage 5*c* is in excess of the refillable amount. Thus, the user can be notified that the ink will overflow the ink tank 18 if the user pours the entirety of the ink in the ink bottle 70.

At S202, the manner of the notification, i.e., the manner of the warning, to the user is changed in accordance with a decrease in the bottle remaining amount. It is thus possible to notify the user that the bottle remaining amount is decreasing, and it is accordingly possible to notify the user that the ink will overflow the ink tank 18.

The process at S306 is executed via S301-S303. In the case where the user has poured the ink of the ink bottle 70 into the ink tank 18 during turn-off of the MFP 1, the bottle remaining amount V1, in which the poured amount is reflected, can be stored in the storage 5*c*.

The process at S115 is executed via S113. This configuration enables the currently attached ink bottle 70 to be readily detached before the bottle remaining amount of the currently attached ink bottle 70 reaches the bottle remaining amount V1 stored in the storage 5*c*. Accordingly, the bottle remaining amount V2 different from the bottle remaining amount V1 stored in the storage 5*c* is stored, and the bottle remaining amounts V1, V2 are mutually different amounts. Because the bottle remaining amounts are mutually different when the ink is poured into the ink tank 18 next time, it is easy to find which one of the ink bottles 70 is to be used. Further, in the case where the user pours the ink using a brand-new ink bottle 70 even though the ink bottle 70 that is partially used exists, the notification to stop the ink pouring using the brand-new ink bottle 70 is given to the user before the bottle remaining amount of the brand-new ink bottle 70 becomes equal to the bottle remaining amount V1 of the partially used ink bottle 70. Accordingly, the bottle remaining amount V2 of the brand-new ink bottle 70 in question is larger than the bottle remaining amount of the partially used ink bottle. As a result, the ink bottle 70 that the user is prompted to use by the notification process at S107 via S106 corresponds to the older ink bottle 70. This is because the bottle remaining amount V1 stored in the storage 5*c* corresponds to the older ink bottle 70 and the bottle remaining amount V1 is smaller than the bottle remaining amount V2 of the newer ink bottle 70, permitting the refillable amount into the ink tank 18 to be readily reach the bottle remaining amount V1.

While the second embodiment has been described above, it is to be understood that the disclosure is not limited to the details of the illustrated second embodiment, but may be embodied with other various changes which may occur to those skilled in the art, without departing from the scope of the disclosure defined in the attached claims. In the illustrated second embodiment, S107 is executed when the refillable amount reaches the stored bottle remaining amount V1 at S106. S107 may be executed after the refillable amount has reached the bottle remaining amount V1.

S103 and S104 do not necessarily have to be executed. In the illustrated second embodiment, the tank remaining amount in the ink tank 18 is determined based on the tank remaining-amount signal output from the remaining-amount detecting sensor 30. Instead, the controller 5 may store a count value relating to ink discharging from the recording head 41, may determine the ink consumption amount based on the count value, and may determine the tank remaining amount by subtracting the ink consumption amount from the tank capacity. This configuration enables the tank remaining amount to be determined without providing the remaining-amount detecting sensor 30. In the case where the tank remaining amount is determined in such a software configuration, the second control flow need not be necessarily executed.

When the control flow goes from S106 to S108 and the ink bottle 70 is attached at S108, the warning process at S109 need not be necessarily executed. Further, S306 need not be necessarily executed even when the tank remaining amount is increased at S305. Further, S115 need not be necessarily executed even when the bottle remaining amounts are mutually different at S113.

Only one of the display portion 1*a* and the buzzer 1*c*, each as the notifying device, may be provided. The ink remaining amount in the ink bottle 70 may be detected by a remaining-amount detecting sensor other than the pair of electrodes 72, such as an optical sensor or a float-type level meter for detecting the liquid level of the ink. In the case where there is employed a remaining-amount detecting sensor (such as an optical sensor) capable of detecting, from outside, the ink remaining amount in the ink bottle 70 attached to the ink tank 18, such a remaining-amount detecting sensor may be provided for the MFP 1. In these configurations, a receiving device for receiving a remaining-amount detection signal from the sensor is provided in the controller 5.

A plurality of ink tanks 18 may be provided in the MFP 1 of the illustrated embodiment. The plurality of ink tanks 18 may respectively store inks of mutually different colors or may store ink of the same color. In this case, the MFP 1 may include the ink bottles 70 storing inks whose colors correspond to colors of the inks stored in the respective ink tanks 18 or may include the ink bottles 70 storing ink whose color corresponds to the color of the ink stored in the plurality of ink tanks 18. Also in this configuration, the bottle remaining amount is determined for each ink bottle 70 in the same manner as described above, and the information relating to the bottle remaining amount in the ink bottle 70 is notified to the user by the notifying device, so that the same advantages as described above are offered.

What is claimed is:

1. A liquid ejecting apparatus, comprising:

a liquid tank including a liquid storing chamber in which a liquid is stored and an inlet through which the liquid is poured into the liquid storing chamber;

an image recorder configured to eject the liquid supplied from the liquid storing chamber, so as to record an image on a recording medium;

a liquid bottle configured to be attachable to and removable from the liquid tank and storing the liquid therein, the liquid bottle being configured such that, in a state in which the liquid bottle is attached to the liquid tank, the liquid is poured into the liquid storing chamber through the inlet independently of a liquid supply from the liquid tank to the image recorder that arises from a liquid ejection from the image recorder, a remaining-amount detecting sensor configured to output a detection signal for determining a liquid remaining amount in the liquid bottle;

a notifying device configured to notify a user of information;

a storage configured to store the liquid remaining amount in the liquid bottle; and a controller configured to control the image recorder and the notifying device, wherein the controller is configured to:

determine the liquid remaining amount in the liquid bottle based on the detection signal output from the remaining-amount detecting sensor, in the state in which the liquid bottle is attached to the liquid tank;

store, in the storage, the determined liquid remaining amount in the liquid bottle; and control the notifying device based on the liquid remaining amount in the liquid bottle stored in the storage to notify the user of remaining-amount information relating to the liquid remaining amount in the liquid bottle, as the information, wherein the liquid tank is provided with a liquid-bottle detecting sensor configured to detect that the liquid bottle is attached to the liquid tank, and wherein the controller is configured to, when the liquid-bottle detecting sensor detects that the liquid bottle is attached to the liquid tank, start the determination of the liquid remaining amount in the liquid bottle.

2. The liquid ejecting apparatus according to claim 1, wherein the storage is configured to store a capacity of the liquid tank and a liquid remaining amount in the liquid tank, and wherein the controller is configured to:

determine a liquid remaining amount in the liquid tank based on the liquid remaining amount in the liquid tank stored in the storage and a liquid discharge amount discharged from the image recorder;

store, in the storage, the determined liquid remaining amount in the liquid tank; and when the liquid is being poured from the liquid bottle into the liquid tank, control the notifying device to notify the user of information indicating that the liquid is about to overflow the liquid tank in a case where it is determined that the liquid remaining amount in the liquid bottle, from which the liquid is being poured, is reduced to such an extent that the liquid is about to overflow the liquid tank, based on the stored liquid remaining amount in the liquid tank, the stored capacity of the liquid tank, and the stored liquid remaining amount in the liquid bottle from which the liquid is being poured.

3. The liquid ejecting apparatus according to claim 1, wherein the notifying device is a display device on which the information is displayable, and wherein the controller controls the display device to display the remaining-amount information relating to the liquid remaining amount in the liquid bottle.

4. The liquid ejecting apparatus according to claim 3, wherein the storage is configured to store a liquid remaining amount in the liquid tank, and wherein the controller is configured to:

determine a liquid remaining amount in the liquid tank based on the liquid remaining amount in the liquid tank stored in the storage and a liquid discharge amount discharged from the image recorder;

store, in the storage, the determined liquid remaining amount in the liquid tank; and control the display device to display the number of recording media to which the liquid is ejectable in a case in which the liquid ejection from the image recorder is performed on the recording medium under a predetermined condition, based on the stored liquid remaining amount in the liquid tank and the stored liquid remaining amount in the liquid bottle.

5. The liquid ejecting apparatus according to claim 1, wherein the remaining-amount detecting sensor includes two electrodes configured to contact the liquid in the liquid bottle, and wherein the controller includes a detection circuit a part of which is provided at the liquid tank, the detection circuit being brought into connection with the two electrodes when the liquid bottle is attached to the liquid tank, so as to detect an electric charge amount of the liquid in the liquid bottle via the two electrodes, and wherein the controller is configured to determine the liquid remaining amount in the liquid bottle based on the electric charge amount detected by the detection circuit.

6. The liquid ejecting apparatus according to claim 5, wherein the controller is configured to start the determination of the liquid remaining amount in the liquid bottle when the electric charge amount detected by the detection circuit changes, by attaching the liquid bottle to the liquid tank, from a value in a first range detected before the liquid bottle is attached to the liquid tank to a value in a second range larger than that in the first range.

7. The liquid ejecting apparatus according to claim 5, wherein, in the state in which the liquid bottle is attached to the liquid tank, the two electrodes extend along a liquid flow direction in which the liquid in the liquid bottle flows into the liquid tank through the inlet.

8. The liquid ejecting apparatus according to claim 7, wherein the liquid bottle is configured to be attached to the liquid tank such that the liquid flow direction inclines with respect to a vertical direction, and wherein the liquid bottle and the liquid tank have respective positioning marks for placing the two electrodes at a lower side portion in the liquid bottle in the state in which the liquid bottle is attached to the liquid tank.

9. A liquid ejecting apparatus, comprising:

a liquid tank including a liquid storing chamber in which a liquid is stored and an inlet through which the liquid is poured into the liquid storing chamber;

an image recorder configured to eject the liquid supplied from the liquid storing chamber, so as to record an image on a recording medium;

a notifying device configured to notify a user of information;

a storage; and a controller configured to control the image recorder and the notifying device, wherein the liquid tank is configured such that a liquid bottle storing the liquid therein is attachable to and removable from the liquid tank, the liquid bottle being configured such that, in a state in which the liquid bottle is attached to the liquid tank, the liquid is poured from the liquid bottle into the liquid storing chamber through the inlet independently of a liquid supply from the liquid tank to the image recorder that arises from a liquid ejection from the image recorder, wherein at least one of the liquid bottle and the liquid ejecting apparatus is provided with a remaining-amount detecting sensor configured to output a detection signal for detecting a liquid remaining amount in the liquid bottle, and wherein the controller is configured to:

determine the liquid remaining amount in the liquid bottle based on the detection signal output from the remaining-amount detecting sensor, in the state in which the liquid bottle is attached to the liquid tank;

store, in the storage, the determined liquid remaining amount in the liquid bottle; and control the notifying device based on the liquid remaining amount in the liquid bottle stored in the storage to notify the user of remaining-amount information relating to the liquid remaining amount in the liquid bottle, as the information, wherein the liquid tank is provided with a liquid-bottle detecting sensor configured to detect that the liquid bottle is attached to the liquid tank, and wherein the controller is configured to, when the liquid-bottle detecting sensor detects that the liquid bottle is attached to the liquid tank, start the determination of the liquid remaining amount in the liquid bottle.

10. A liquid ejecting apparatus, comprising:

a liquid tank configured such that a liquid bottle storing a liquid therein is attachable to and removable from the liquid tank, the liquid tank including (i) an inlet through which the liquid in the liquid bottle is poured in a state in which the liquid bottle is attached to the liquid tank and (ii) a liquid storing chamber storing the liquid poured thereinto through the inlet;

an image recorder configured to eject the liquid supplied from the liquid storing chamber, so as to record an image on a recording medium;

a receiving device configured to receive a bottle remaining-amount signal for determining a bottle remaining amount which is a liquid remaining amount in the liquid bottle attached to the inlet;

a tank remaining-amount output device configured to output a tank remaining-amount signal for determining a tank remaining amount which is a liquid remaining amount in the liquid tank;

a storage;

a notifying device configured to notify the image recorder and a user of information; and a controller, wherein the controller is configured to:

in the state in which the liquid bottle is attached to the liquid tank, determine the bottle remaining amount in the liquid bottle attached to the liquid tank based on the bottle remaining-amount signal received by the receiving device;

store the determined bottle remaining amount in the storage;

determine the tank remaining amount based on the output tank remaining-amount signal; and when the bottle remaining amount stored in the storage is smaller than or equal to a difference between a maximum capacity of the liquid tank and the determined tank remaining amount, control the notifying device to give the user a remaining-amount pouring notification indicating that the liquid can be poured from the liquid bottle whose bottle remaining amount is stored in the storage.

11. The liquid ejecting apparatus according to claim 10, wherein the controller is configured to, when the difference reaches the bottle remaining amount stored in the storage, control the notifying device to give the user the remaining-amount pouring notification.

12. The liquid ejecting apparatus according to claim 10, wherein the storage is configured to store a threshold indicating a state that an amount of the liquid stored in the liquid tank is small, and wherein the controller is configured to:

when the determined tank remaining amount reaches the threshold, control the notifying device to give the user a tank remaining-amount notification indicating that the tank remaining amount is small; and give the user the remaining-amount pouring notification before the tank remaining amount reaches the threshold.

13. The liquid ejecting apparatus according to claim 10, wherein the controller is configured to, when the liquid in the liquid bottle currently attached to the liquid tank is poured into the liquid tank in a state in which a condition that the bottle remaining amount stored in the storage is smaller than or equal to the difference is not satisfied, control the notifying device to give a warning to the user.

14. The liquid ejecting apparatus according to claim 13, wherein the controller is configured to control the notifying device to change a manner of the warning in accordance with a decrease in the bottle remaining amount in the liquid bottle currently attached to the liquid tank.

15. The liquid ejecting apparatus according to claim 10, wherein the controller is configured to, when the tank remaining amount determined at an ON time is larger than the tank remaining amount stored in the storage prior to the ON time, store, in the storage, a bottle remaining amount obtained by subtracting an increased amount of the liquid from the bottle remaining amount stored in the storage prior to the ON time, the ON time being a time when a power source of the liquid ejecting apparatus is changed to an ON state from an OFF state.

16. The liquid ejecting apparatus according to claim 10, wherein the controller is configured to, when the bottle remaining amount in the liquid bottle currently attached to the liquid tank differs from the bottle remaining amount stored in the storage, control the notifying device to give a notification to prompt the user to stop pouring the liquid from the liquid bottle currently attached to the ink tank.

17. The liquid ejecting apparatus according to claim 16, wherein the controller is configured to, when the bottle remaining amount in the liquid bottle currently attached to the liquid tank differs from the bottle remaining amount stored in the storage, control the notifying device to give the notification to prompt the user to stop pouring the liquid from the liquid bottle currently attached to the ink tank before the bottle remaining amount determined for the currently attached liquid bottle reaches the bottle remaining amount stored in the storage.

* * * * *